United States Patent [19]

Yamada

[11] 4,187,629

[45] Feb. 12, 1980

[54] PERPETUAL AND MULTI-YEAR CALENDARS

[75] Inventor: Yoshikazu Yamada, Irvine, Calif.

[73] Assignee: Yamada-Graphics Corp., Costa Mesa, Calif.

[21] Appl. No.: 833,522

[22] Filed: Sep. 15, 1977

[51] Int. Cl.[2] ..... G09D 3/10

[52] U.S. Cl. ..... 40/109; 40/118

[58] Field of Search ..... 40/109, 110, 107, 116–118; 283/2–4

[56] References Cited

U.S. PATENT DOCUMENTS

| | | | |
|---|---|---|---|
| 219,156 | 9/1879 | Heath | 40/109 |
| 726,979 | 5/1903 | O'Marra | 40/109 |
| 786,618 | 4/1905 | Ball et al. | 40/109 |
| 1,073,206 | 9/1913 | Zabriskie | 40/109 |
| 1,266,499 | 5/1918 | Leckey | 40/109 |
| 1,275,350 | 8/1918 | Wynne | 40/109 |
| 1,360,004 | 11/1920 | Monk | 40/109 |
| 1,513,253 | 10/1924 | Lape | 40/109 |
| 1,520,648 | 12/1924 | Holt | 40/107 |
| 1,558,020 | 10/1925 | Lauer | 40/109 |
| 1,687,950 | 10/1928 | Palmer | 40/109 |
| 1,949,328 | 2/1934 | Pinkerton | 40/109 |
| 2,305,370 | 12/1942 | Wissing | 40/110 |
| 2,335,713 | 11/1943 | Vogel | 40/109 |
| 2,397,877 | 4/1946 | Mayhew | 40/109 |
| 2,567,395 | 9/1951 | Peterson | 40/109 X |
| 3,443,331 | 5/1969 | Davis | 40/109 |

OTHER PUBLICATIONS

Wittnauer 2002 Watch-Perpetual Calendar Ad, Los Angeles Times Home Magazine, 12-1-1974.

*Primary Examiner*—John F. Pitrelli

*Attorney, Agent, or Firm*—Benoit Law Corporation

[57] ABSTRACT

A family of novel perpetual and multi-year calendars is obtained by various dispositions of four calendar data components, namely (1) calendar data comprising indications of the days of the month by number, (2) calendar data comprising indications of the days of the week by name, (3) calendar data comprising indications of the months of the year, and (4) indexing feature. The calendar data components are arranged in pairs on first and second display devices, one of which is movable relative to the other. The indexing feature in the perpetual calendar designs comprises a set of seven index positions and a movable index element locatable at any one of these positions. The indexing feature in multi-year calendar designs comprises a set of seven index positions labeled with calendar data including indications of the years by number. The disclosed family of calendars also includes species wherein the calendar data components consist of multiply listed calendar data on a first display surface and a set of other calendar data on a second display surface having a frame for, and being movable relative to, the first display surface.

31 Claims, 42 Drawing Figures

M T W T F S S M T W T F S S M T W T F
JAN FEB'FEB JAN'
14
NOV JUN SEP APR
OCT MAY AUG MAR DEC JUL
11
11a 1 2 3 4 5 6 7
8 9 10 11 12 13 14
15 16 17 18 19 20 21
12
22 23 24 25 26 27 28
12a
29 30 31
78 83 82 81 80 -- 79
27
89 88 -- 87 86 85 84

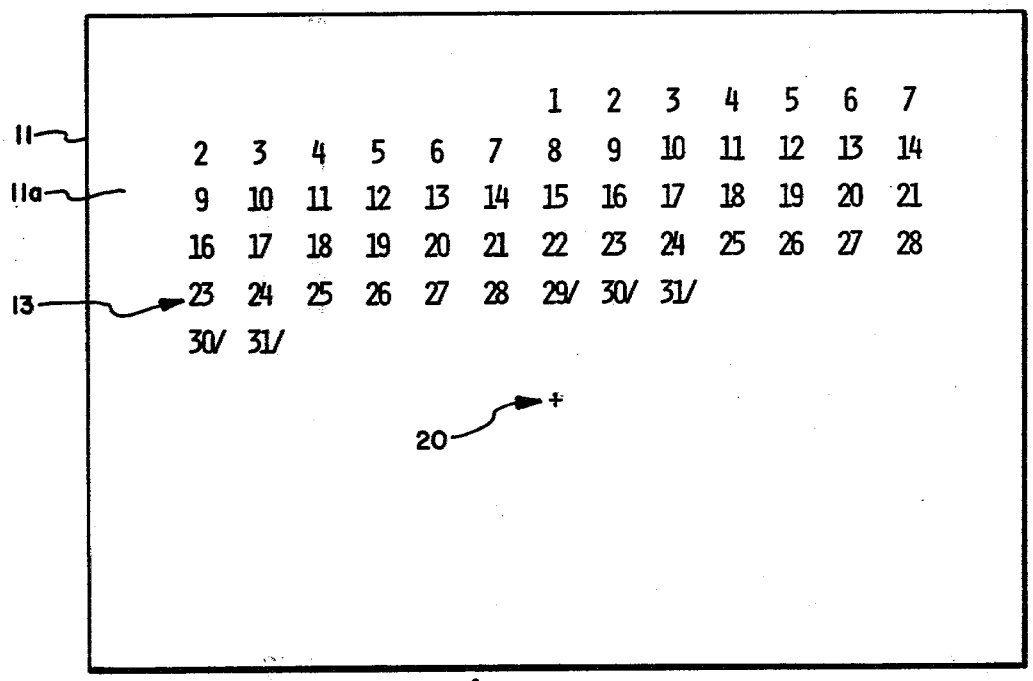
Fig 32
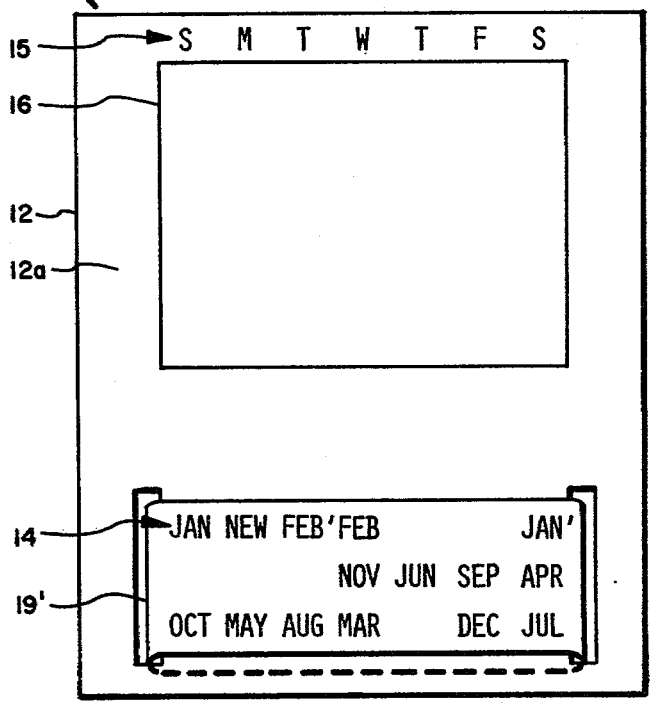

PERPETUAL AND MULTI-YEAR CALENDARS

BACKGROUND OF THE INVENTION

1. Field of the Invention

The subject invention relates to calendars, including perpetual and multi-year calendars, calendar design and calendar construction.

2. Description of the Prior Art

The present Gregorian calendar, widely used throughout the Occident, is characterized by constant monthly changes either in the day-of-the-week start of a month or its length, or both. Successive years do not begin on the same day of the week. To keep up with these changes, new calendars are printed every year, which become useless and are discarded at the end of the particular year.

Perpetual and multi-year calendars are designed to display the calendar of each month of the year, year after year, utilizing the same two sets of imprinted calendar data. The pair of data components used for display are calendar data comprising indications of the days of the week by name and calendar data comprising indications of the days of the month by number. Since these two calendar data sets have a constantly changing relationship to each other from month to month (except from February to March in a common year), they are put on separate panels or other means, one of which is made movable relative to the other which is typically kept stationary. There are seven positions of the movable means relative to the stationary means, representing the seven possible relationships between the two calendar data sets with the beginning of a month on each of the seven days of the week.

Calendar setting has to do with the positioning of the movable means bearing one set of calendar data relative to the stationary means bearing the other set of calendar data so that the columns of the days of the week by name and the numbers of the days of the month are properly aligned to display the calendar for a particular month of the year.

Prior-art proposals in this area have made various attempts at teaching the user where to position the mentioned movable means relative to the stationary means.

In a first group of prior-art proposals are calendars in which information on calendar setting is obtained from prepared tables and charts attached to the calendars. It is a simple matter to construct "perpetual calendar" charts and tables covering periods of decades and centuries. Such tables are attached to the calendars of Wynne, U.S. Pat. No. 1,275,350, and Mayhew, U.S. Pat. No. 2,397,877, for reference by the user. A Pennygraf slide chart calendar (Pennygraf Division of Nashua Corporation of Los Angeles, Calif.) also belongs in this category although it is designed for only a short period (e.g. 1970–75).

In a second group of prior art proposals are calendars in which the only information supplied are the lengths of the months. From the current setting of the calendar, information as to the length of the current month can be used by the user to determine the day-of-the-week start of the following month and to reset the calendar accordingly.

This method suffers disadvantages in that the displays of the monthly calendars can be shown only in sequence and there is no correlation between the month for which the calendar is set and the displayed other calendar data. A prior-art calendar marked "Mormon Temple, Salt Lake City" is an example of a calendar in this class. Briefly, that prior-art calendar has the months and their respective lengths listed on a wheel which is rotatable relative to a window through which the name of one month at a time and the number of its days are visible. The days of the month are contained in a thirteen-column set on an endless tape which is movable relative to a stationary set of days of the week by name.

In the prior art are the calendars on the commercially available calendar wrist watches by Longines-Wittnauer Watch Company and by Neuvex, and the circular pocket calendar of Anderson & Sons, Inc. of Westfield, Mass. Briefly, these calendars have the days of the week by name listed in a first circular array on a disc, and a number of years in a second circular array on that disc. The days of the week listings are visible through a first elongate window relative to a stationary seven-column list of days of the month. The year listings are visible through a second elongate window relative to a seven-column stationary list of the months by name. Leap years are handled by special listings of January and February. Also in this category is the calendar of Lauer, U.S. Pat. No. 1,558,020.

Zabriskie's calendar, U.S. Pat. No. 1,073,206 has the semblance of belonging to the last group in that it uses an index and calendar data comprising indications of the months of the year in calendar setting, but like the calendars of the above mentioned first group, it also has a table of years for reference in selecting the index for the year.

The calendar data comprising indications of the months of the year are not simply a listing of the months of the year in sequence. Starting with the indication of January, the indication of each successive month is put down successively in selected columns of a seven-column scale according to the length of the previous month. The resultant distribution shows the indications of the months of the year arranged according to their day-of-the-week beginnings relative to that of January and, therefore, relative to each other's.

In some prior-art calendars, calendar data comprising indications of the months of the year include additional and separate indications of January and February to be used only in a leap year.

Some prior-art proposals include an index feature intended to facilitate setting. In Lauer, U.S. Pat. No. 1,558,020 the index is the 1-column (column comprising the numbers 1, 8, 15, 22, 29) in the indications of the days of the month by number.

In Zabriskie, U.S. Pat. No. 1,073,206, the index is one of the alphabetically keyed positions. In the calendars on the Neuvex and Longines-Wittnauer wrist watches and the circular calendar of Anderson & Sons, Inc., the index is the indication of the year included in the calendar data comprising indications of the years by number.

The position of the index relative to the calendar data comprising indications of the months of the year which is good in setting the calendars of the months of the year in a particular year will not be good for the following year. For the calendar setting procedure to be operative each year, the position of the index can be changed each year. This introduces the problem of determining the index position for each new year. It is the manner in which this is done which determines the nature of the calendars.

In the calendars on the Neuvex and Longines-Wittnauer wrist watches and the circular pocket calendar of Anderson & Sons, Inc., the indication of the year marks the index position for the year and the indication of the following year in an adjacent or next to an adjacent position represents the adjustment in index position for the following year as well as the index position for the following year. Since the new positions of the index for each year are predetermined and pre-labeled with the indications of the years, the life or duration of usefulness of a calendar is limited to the indications of the years contained in the particular calendar. These calendars which include indications of the years have a beginning and an end and are, therefore, at best multi-year, but not perpetual calendars.

It is axiomatic that a calendar in this group to be operated perpetually cannot have the new index positions for the years pre-determined and pre-labeled. This information must be self-generated to obtain continuous operation of the calendar.

The calendar of Ball et al, U.S. Pat. No. 786,618, is an annular calendar displaying all twelve monthly calendars at a time. In operation, it is similar to the monthly calendars in the above mentioned group having an indexing feature, in that the twelve monthly calendars are set (at one time) by aligning an index with an indication of the year included in calendar data comprising indications of the years by number. However, the calendar data comprising indications of the years in the calendar of Ball et al are more akin to the calendar data comprising indications of the months of the year than to the calendar data comprising indications of the years found in the calendars on the above mentioned wrist watches, because these calendar data (e.g. Ball et al) do not have any indexing function for the months.

The calendar by Leckey, U.S. Pat. No. 1,266,499, serves only the purpose of display, while Davis' perpetual calendar machine, U.S. Pat. No. 3,443,331, is immensely mechanically complex.

SUMMARY OF THE INVENTION

It is generally an object of my present invention to overcome the above mentioned disadvantages.

It is a related object of my invention to provide novel perpetual and multi-year calendars.

It is a germane object of my invention to provide new concepts in the design and construction of perpetual and multi-year calendars and a family of novel calendar designs and constructions resulting from the application of these concepts in combination.

It is a further object of my invention to provide a general and systematic method for building perpetual calendars.

It is a related object of my invention to provide for a convenient and reliable adjustment of calendars from year to year of their use.

It is a further object of my invention to increase the size of the monthly calendar display relative to the overall size of the calendar device, as compared to prior-art calendar devices of a similar nature.

Other objects will become apparent in the further course of my subject disclosure.

The components of my calendars in accordance with a first aspect of my invention are (a) the four data components and (b) the first and second means on which these data components are located.

The four data components of my perpetual calendar designs are listed below with statements of their functions:

(1) and (2). The first two calendar data, used jointly in displaying monthly calendars, comprise indications of the days of the week by name and calendar data comprising indications of the days of the month by number.

(3) Third calendar data comprising indications of the months of the year, used jointly with (4) in setting monthly calendars, according to the subject aspect of my invention include an indication of January of a new year, separate and distinct from the indication of January of the current year.

(4) Index, used jointly with (3) in setting monthly calendars.

The index (4) and the third calendar data (3) are the calendar setting components. They are located separately on the first and second means bearing the first two calendar data and are placed in operative relationship on these two means such that the process of aligning the index with the indication of a month in the third calendar data puts the first two calendar data in proper relationship to display the calendar of the month.

The calendar setting components make it possible for the user to set each month's calendar correctly, without need on his part to refer to a chart or table of calendar data or the like, or to any other calendar.

The position of the index which is good or valid in setting the monthly calendars in a particular year will not be good or valid for the following year. The index position has to be changed each year relative to the third calendar data in order to have the two components in operative relationship for calendar setting in the following year.

The need for this adjustment in index position once a year, at the beginning, is due to the length of a year and to the fixed arrangement of the indications of the months included in the third calendar data. The fact that a common year has 365 days and a leap year, 366 days, instead of an even multiple of seven ($7\times52=364$ days), causes each successive year to start on a day of the week different from that of the previous year. The consequent change in the day-of-the-week beginning for January requires a shift of the whole set of the third calendar data relative to the index position, or conversely, of the index position relative to the third calendar data.

This change in index position each year results in the formation of a scale of seven index positions over which the index moves cyclically.

A novel feature of the currently discussed aspect of my invention is a movable index element, included in the indexing means of my perpetual calendar designs which serves as a marker for the index position of the current year and which makes it possible to make a change in the index position for each new year.

Another novel feature of the currently discussed aspect of my invention includes third calendar data comprising indications of the months of the year and including an indication of January of a new year, which is separate and distinct from the indications of January of the year and which is an aid in determining the new index position for a new year. Besides an informational knowledge as to whether the new year is a common year or a leap year, no statement of the year is necessary in determining the index position for each new year. The procedure I have developed for determining the new index position employs the novel features of my invention mentioned above. My resulting calendar designs then are truly perpetual.

My indexing means, comprising a set of seven index positions and a movable index element, are counted as a data component although no calendar data is included. Later, the index positions are labeled with the indications of the years by number when the perpetual calendar designs are converted to multi-year calendar designs.

What I refer to as the "columns" of the indexing means are really the "index positions" of the indexing means.

From another aspect thereof, my invention resides in a calendar comprising, in combination, first means defining a first display surface, second means defining a second display surface, third means operatively associated with the first and second means for mounting the first means including the first display surface in a relatively stationary position, and for mounting the second means including the second display surface for movement relative to the first display surface, a set of first calendar data on the second means at the second display surface, and multiply listed second calendar data on the first means at the first display surface, one of the first and second data comprising indications of the days of the week by name, and the other of the first and second calendar data comprising indications of the days of the month by number. In a preferred embodiment of this aspect, the second means may define a frame for part of the first display surface, and the mounting means may mount the second display surface and the frame for movement relative to the first display surface.

From another aspect thereof, my invention resides in a perpetual calendar comprising, in combination, first means bearing first calendar data, second means movable relative to the first means and bearing second calendar data, one of the first and second calendar data comprising indications of the days of the week by name, and the other of the first and second calendar data comprising indications of the days of the month by number, one of the first and second calendar data being multiply listed, and the other of the first and second calendar data being singly listed, means for controlling adjustment of the second means relative to the first means in accordance with different occurring calendar interrelationships of the first and second calendar data each month, comprising third calendar data including indications of the months of the year associated with one of the first and second means and corresponding indexing means associated with the other of the first and second means, and means including in the indexing means an index element movable relative to the other of the first and second means with which the indexing means are associated for modifying periodically the control of adjustment of the second means relative to the first means.

From another aspect thereof, my invention resides in a perpetual calendar comprising, in combination, first means bearing first calendar data, second means movable relative to the first means and bearing second calendar data, one of the first and second calendar data comprising indications of the days of the week by name, and the other of the first and second calendar data comprising indications of the days of the month by number, one of the first and second calendar data being multiply listed, and the other of first and second calendar data being singly listed, means for controlling adjustments of the second means relative to the first means in accordance with different occurring calendar interrelationships of the first and second calendar data each month, including third calendar data and corresponding adjustable indexing means, and means for determining the adjustment each year of the indexing means relative to the third calendar data and to the other of the first and second means with which the index means are associated, the third calendar data comprising indications of the months of the year listed successively in selected columns according to their relative day-of-the week beginnings and including an indication of January of a new year being separate and distinct from an indication of January of the months of the year, and being listed relative to the indication of December of the months of the year in accordance with the length of the month of December.

From another aspect thereof, my invention resides in a perpetual calendar comprising, in combination, first means bearing first calendar data, second means movable relative to the first means and bearing second calendar data, one of the first and second calendar data comprising indications of the days of the week by name, and the other of the first and second calendar data comprising indications of the days of the month by number, one of the first and second calendar data being multiply listed, and the other of first and second calendar data being singly listed, means for controlling adjustments of the second means relative to the first means in accordance with different occurring calendar interrelationships of the first and second calendar data each month, comprising third calendar data including indications of the months of the year associated with one of the first and second means and corresponding indexing means associated with the other of the first and second means, and means for extending the usability of the calendar to an indefinitely long time, comprising means for making an adjustment each year of the indexing means relative to the third calendar data and to the other of the first and second means with which the indexing means are associated, including in the indexing means an index element movable relative to the other of the first and second means, said indexing element comprising a removable marker which further aids in said relative moving of said first and second means, and said indexing means including in the third calendar data an indication representing January of any year located in terms of an indexing position associated with the year preceding the particular year, and being separate and distinct from an indication of January of the preceding year.

From another aspect thereof, my invention resides in a multi-year calendar comprising, in combination, first means bearing first calendar data, second means movable relative to the first means and bearing second calendar data, one of the first and second calendar data comprising indications of the days of the week by name, and the other of the first and second calendar data comprising indications of the days of the month by number, one of the first and second calendar data being multiply listed with both right and left margins, and the other of the first and second calendar data being singly listed;

means for controlling adjustments of the second means relative to the first means in accordance with different occurring calendar interrelationships of the first and second calendar data each month including third calendar data and corresponding indexing means, the third calendar data comprising indications of the months of the year, and the indexing means comprising a cyclically usable set of several index positions labeled with calendar data comprising indications of the year by number, wherein the given indication of any year included in the calendar data is in operative relationship with the third calendar data as the index position for the year.

From yet another aspect thereof, my invention resides in a perpetual calendar comprising, in combination, first means bearing first calendar data, second means movable relative to said first means and bearing second calendar data, one of the first and second calendar data comprising indications of the days of the week by name, and the other of the first and second calendar data comprising indications of the days of the month by number, one of the first and second calendar data being multiply listed, and the other of the first and second calendar data being singly listed, means for controlling adjustment of the second means relative to the first means in accordance with different occurring calendar interrelationships of the first and second calendar data each month, comprising multiply listed third calendar data including indications of the months of the year associated with one of the first and second means and corresponding indexing means comprising a single, fixed index position associated with the other of the first and second means, and means for extending the usability of the calendar to an indefinitely long time, comprising means for determining and making an adjustment each year of the third calendar data relative to the indexing means and to said one of the first and second means comprising third means, with said third calendar data including an indication of January of a new year, separate and distinct from the indication of January of the year, and listed relative to the indication of December according to the length of the month of December in a column including an indication of the month of May of said indications of the months of the year, and said third means comprising a flexible medium in an endless loop configuration attached to and movable relative to said one of said first and second means and bearing said third calendar data including said indication of January of a new year for display in a single listing at a time relative to said single, fixed index position.

From still another aspect thereof, my invention resides in a calendar comprising, in combination, first means bearing first calendar data, second means movable relative to the first means and bearing second calendar data, one of the first and second calendar data comprising indications of the days of the week by name, and the other of the first and second calendar data comprising indications of the days of the month by number, one of the first and second calendar data being multiply listed, and the other of the first and second calendar data being singly listed, means for controlling adjustment of the second means relative to the first means in accordance with different occurring calendar interrelationships of the first and second calendar data each month, comprising third calendar data comprising indications of the months of the year associated with one of the first and second means, and corresponding indexing means associated with the other of the first and second means, and means for determining and making an adjustment each year of the indexing means relative to the third calendar data and to the other of the first and second means with which the indexing means are associated, comprising in the indexing means an index element movable relative to the other of the first and second means and a cyclically usable set of seven index positions, at any one of which the movable index element is locatable.

BRIEF DESCRIPTIONS OF THE DRAWINGS

My invention and its various aspects and objects will become more readily apparent from the following detailed description of preferred embodiments thereof, illustrated by way of example in the accompanying drawings, in which like reference numerals designate like or functionally equivalent parts, and in which.

Figure 3C:
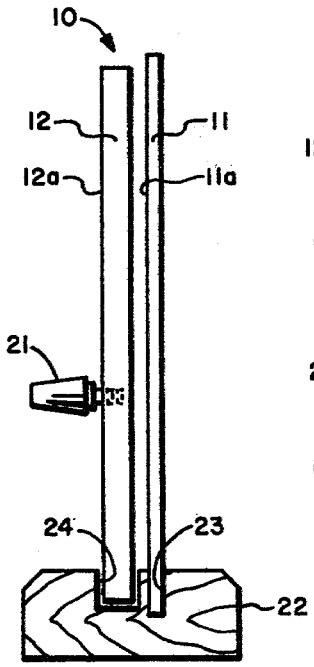
Figure 3C:
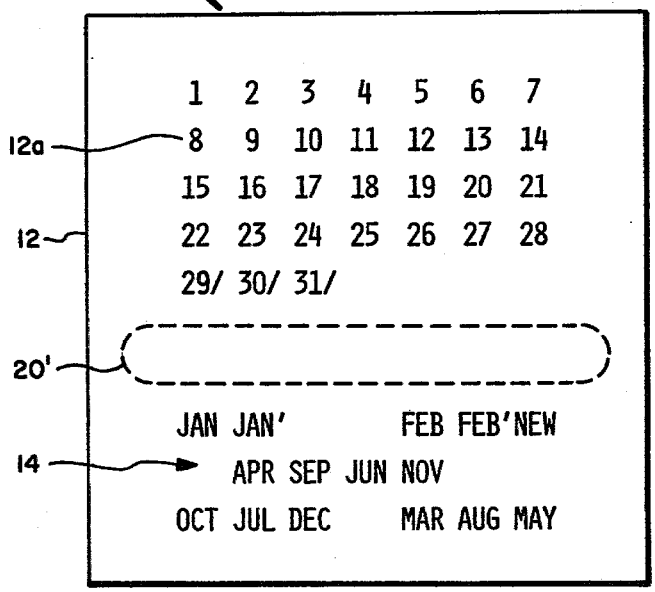
Figure 3A:
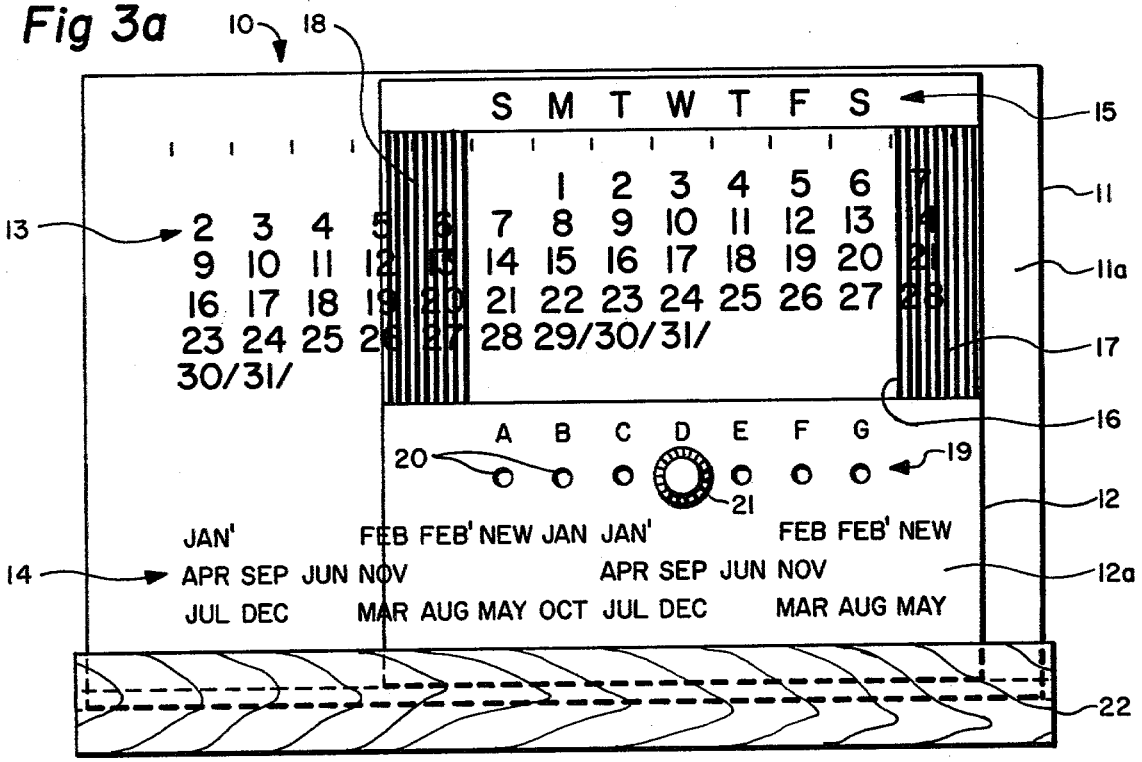
Figure 3B:
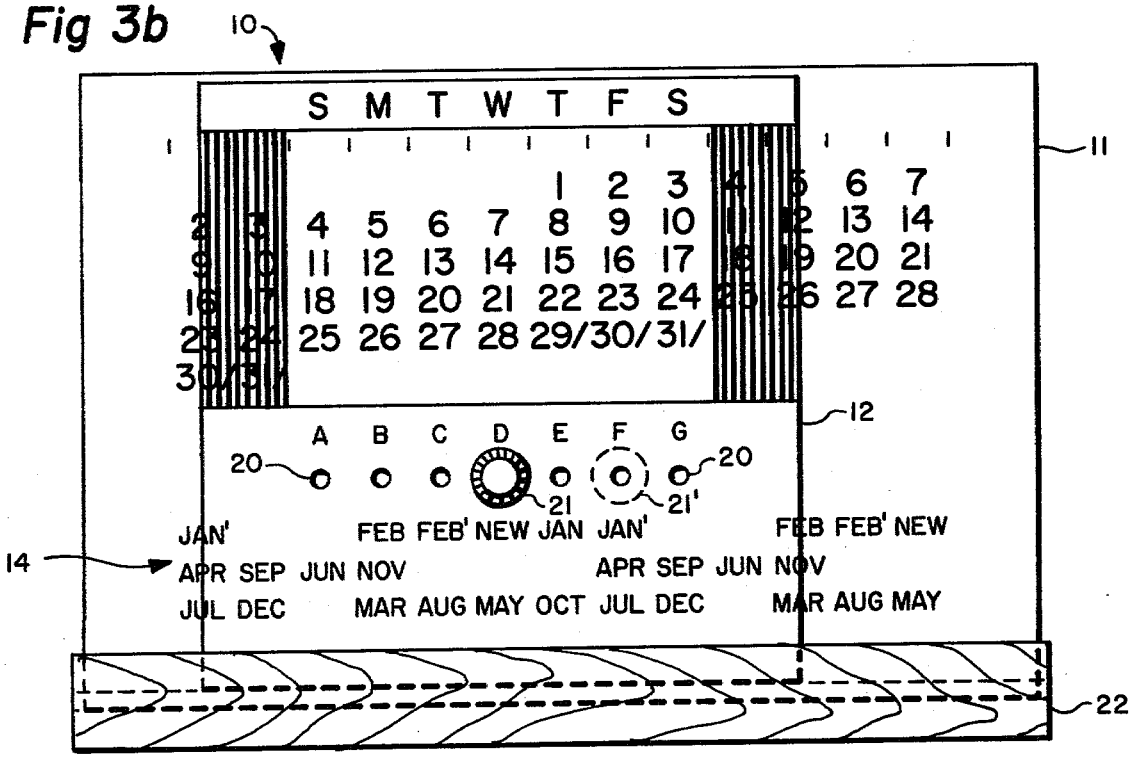

FIG. 3*a* to *c* jointly show perpetual calendar design III, and in particular constitute in FIG. 3*a* a front elevation of a perpetual calendar according to a preferred embodiment of my subject invention in a first position of a movable panel, and in FIG. 3*b* a front elevation of the calendar of FIG. 3*a* in a second position of the movable panel, and in FIG 3*c* a side view of the calendar of FIGS. 3*a* and *b;*

Figure 4:
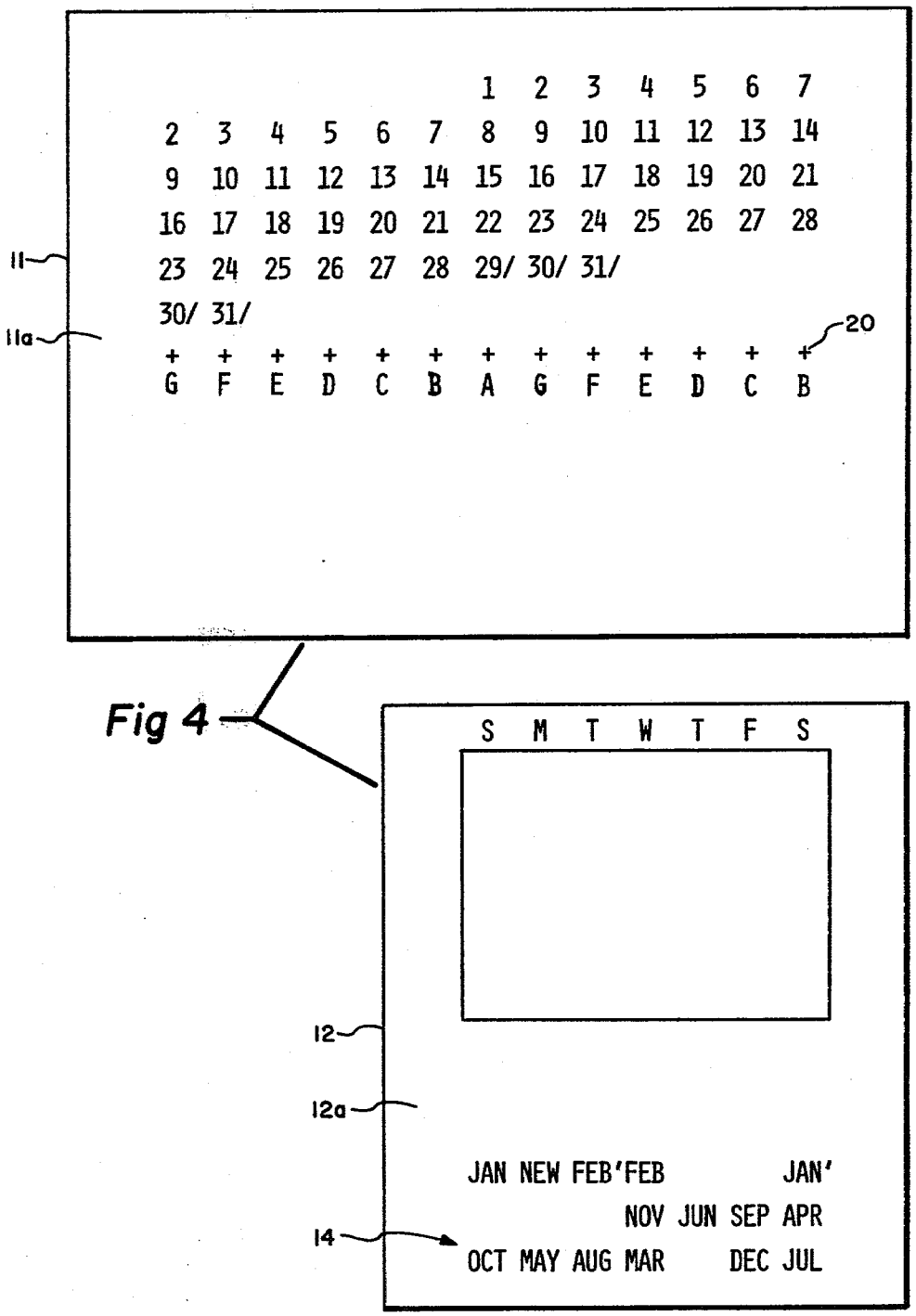
Figure 5:
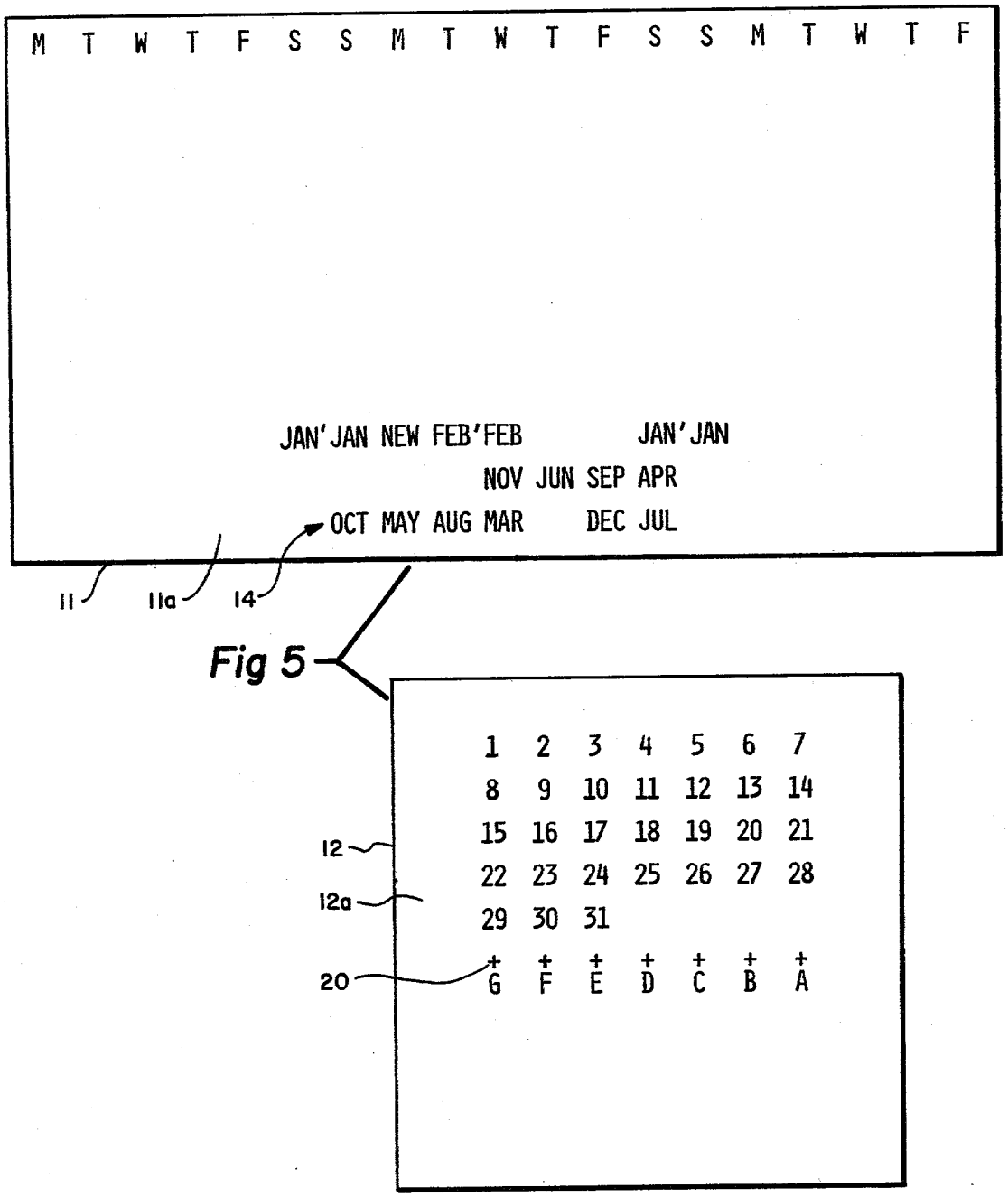
Figure 6:
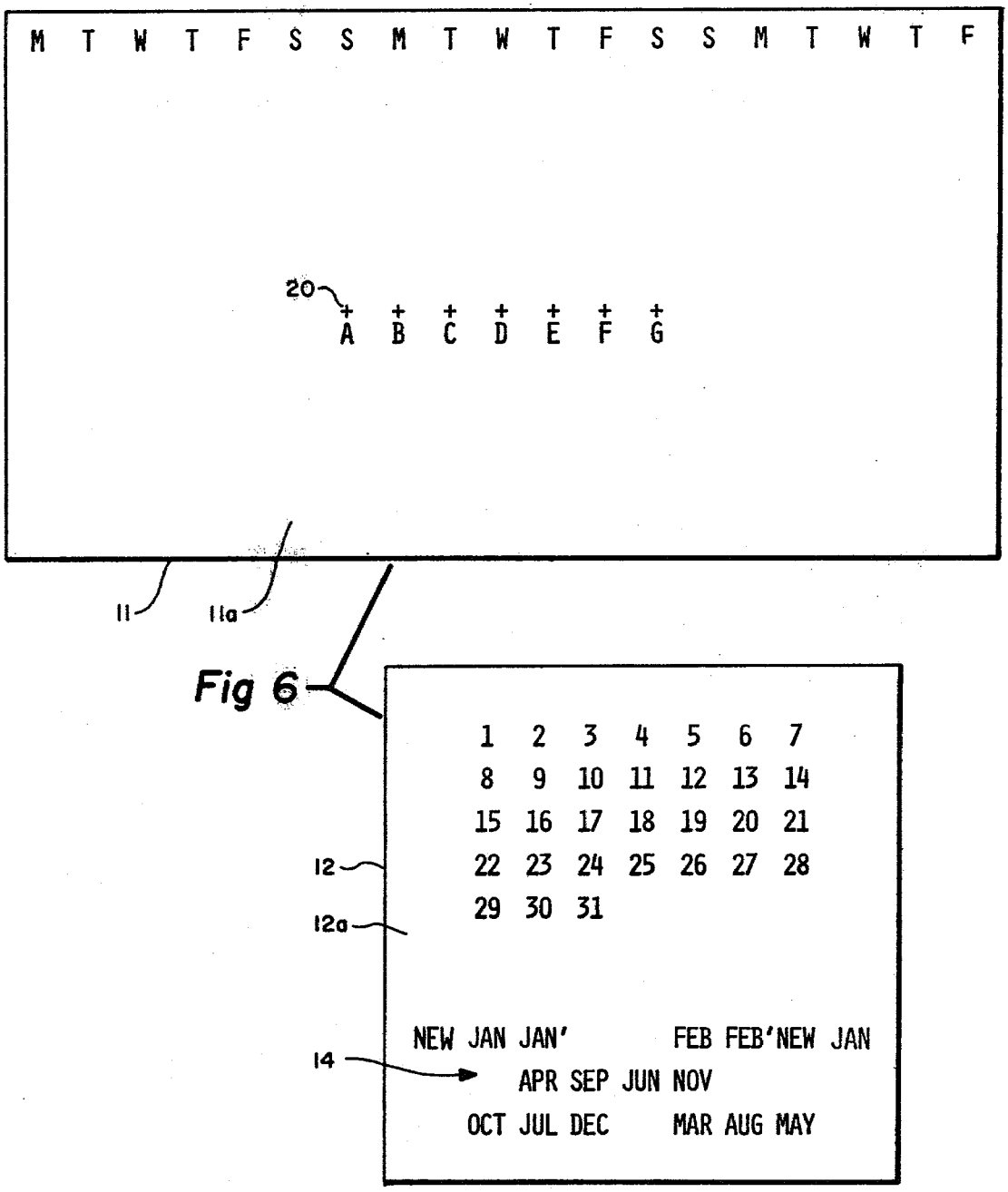
Figure 7:
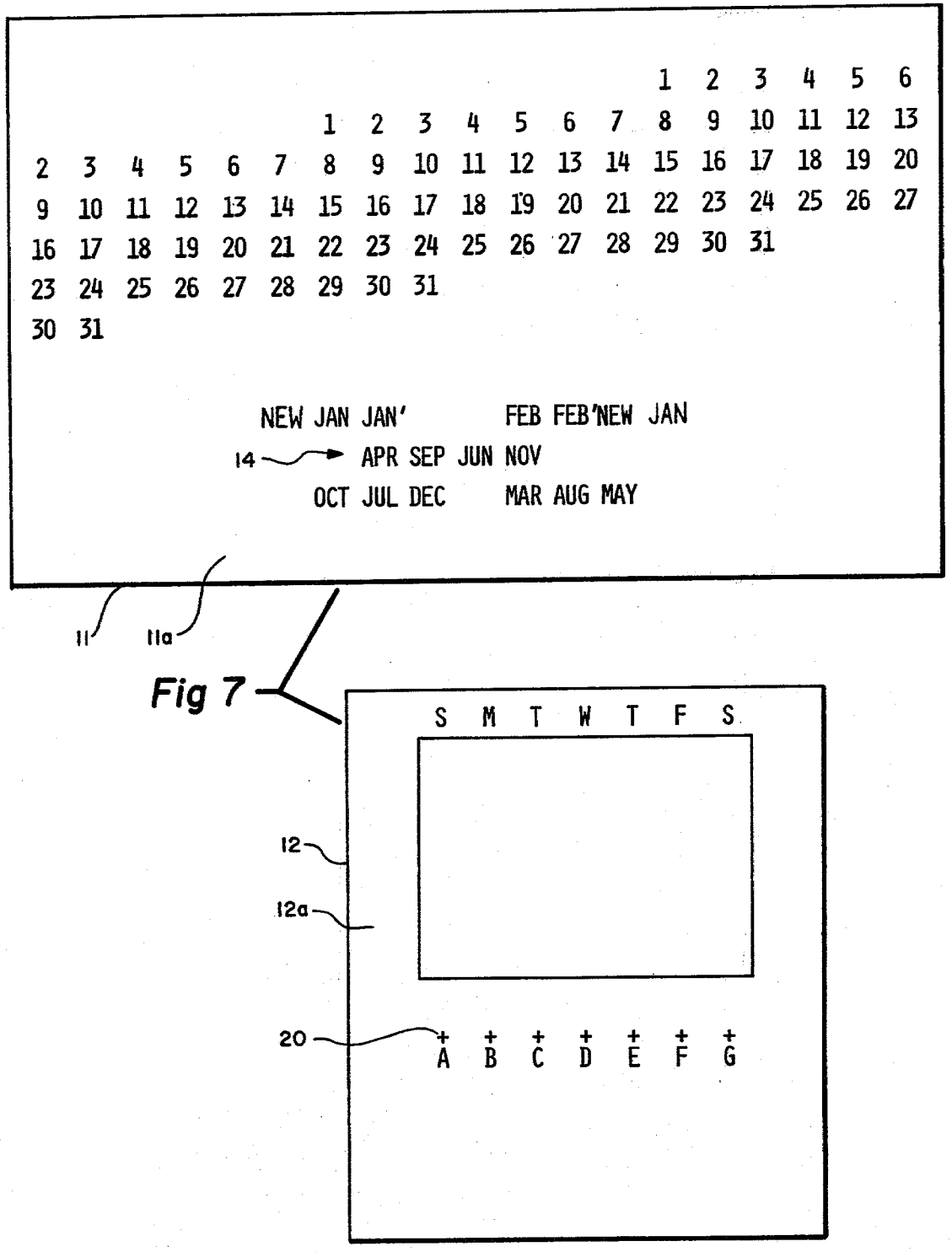
Figure 8:
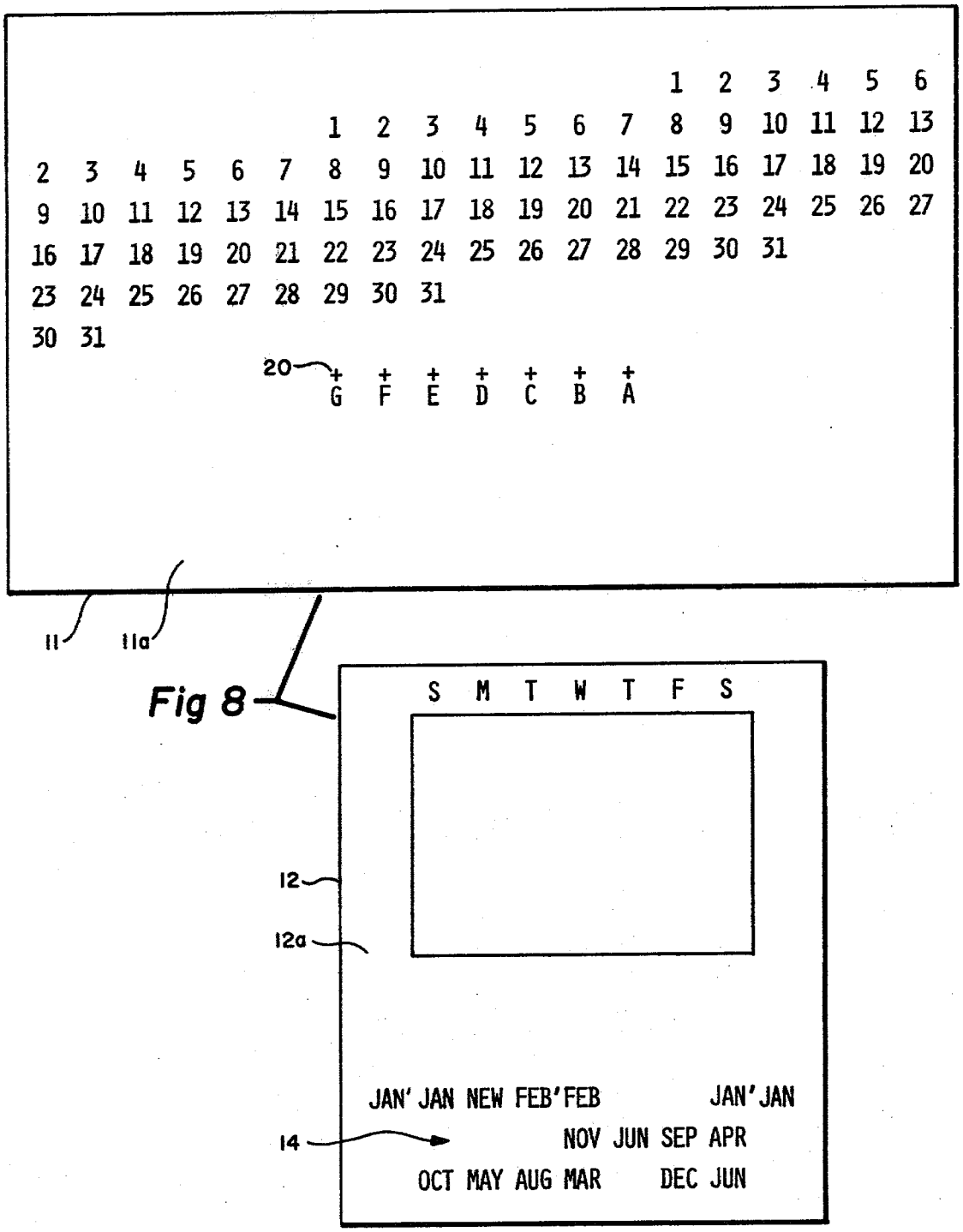
Figure 9:
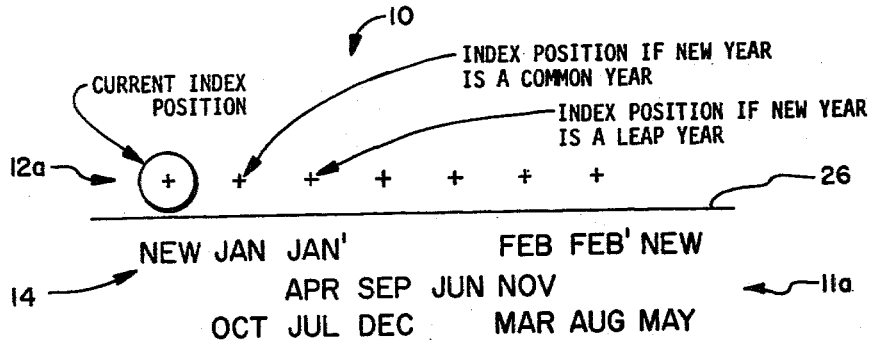
Figure 10:
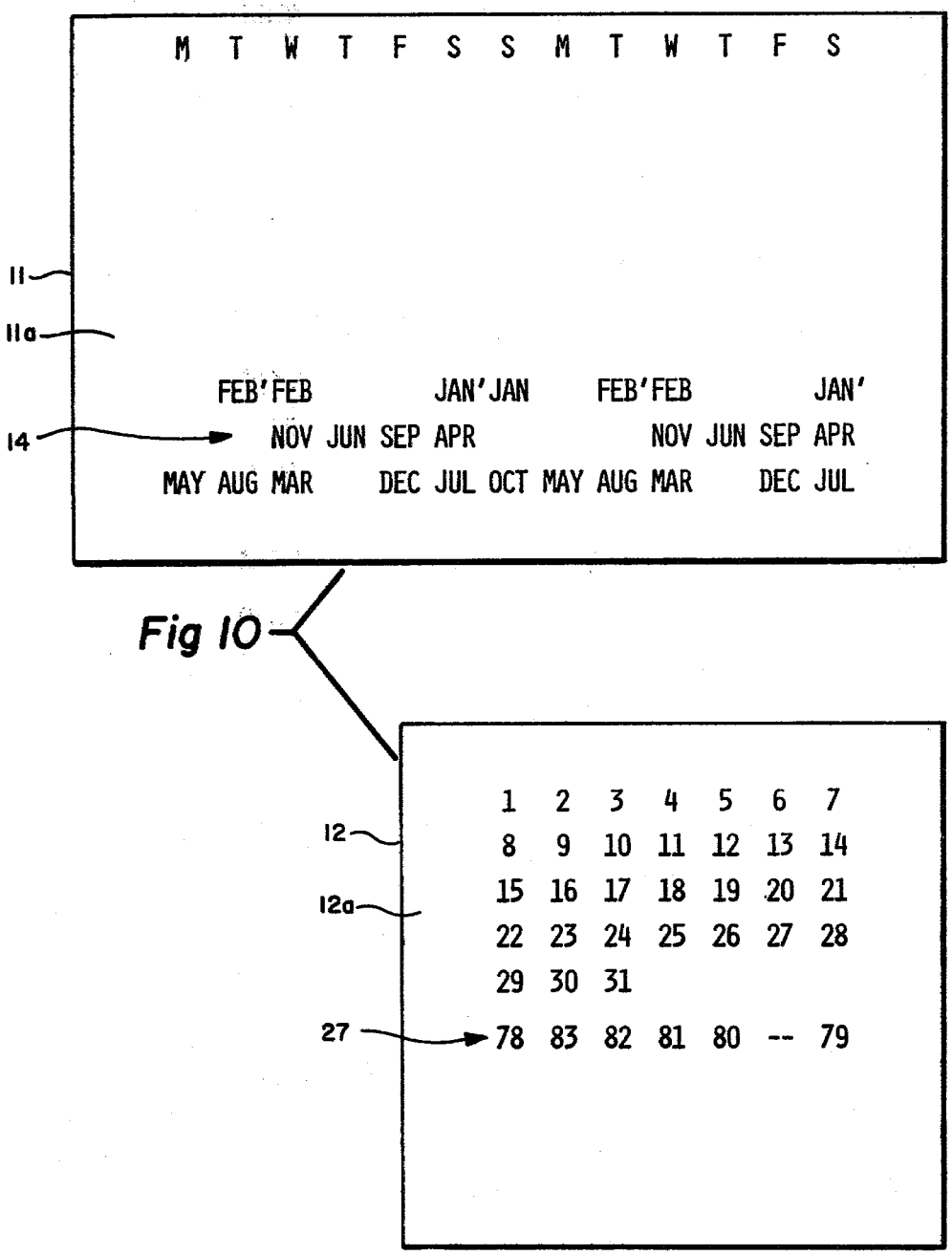
Figure 12:
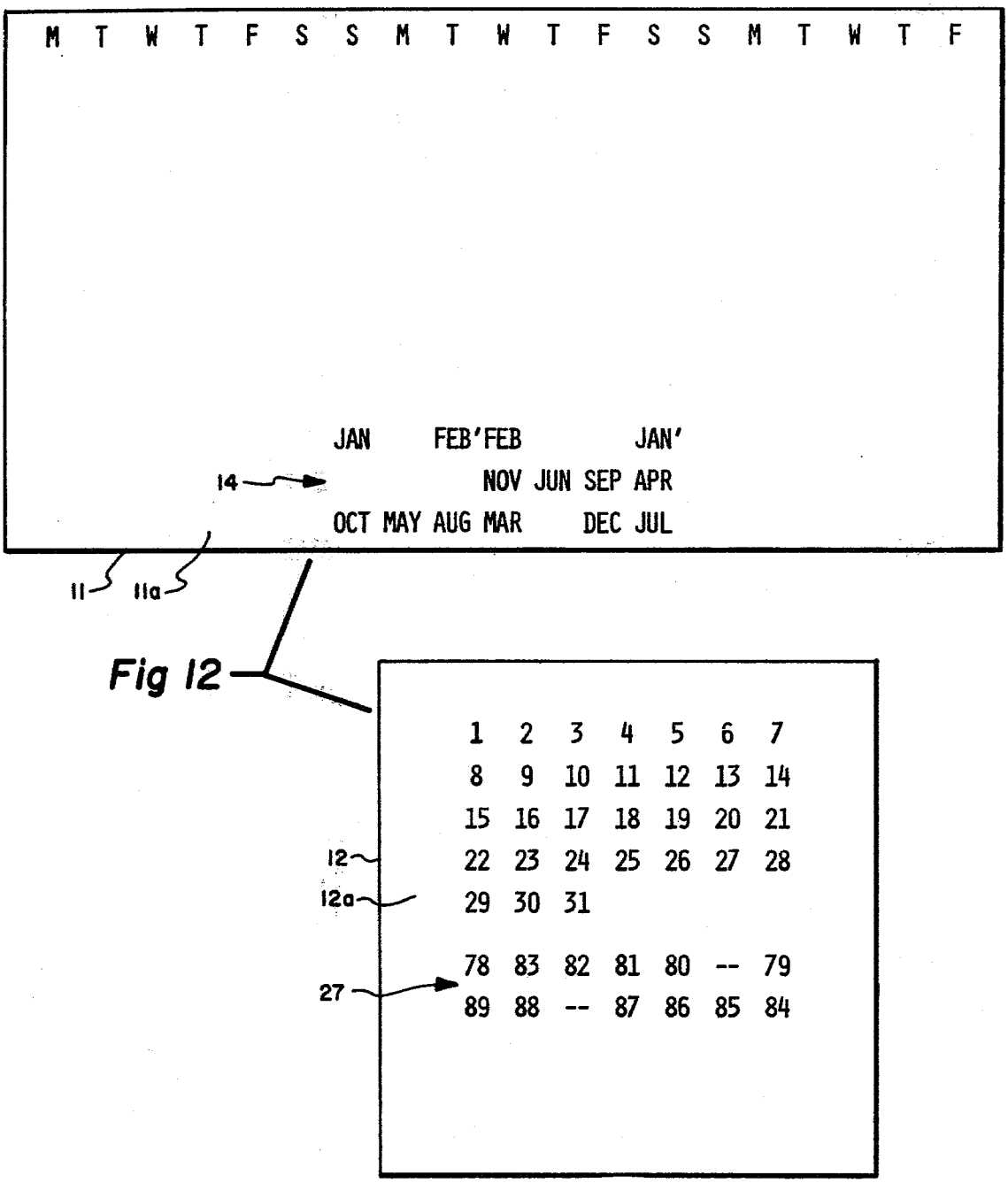
Figure 13:
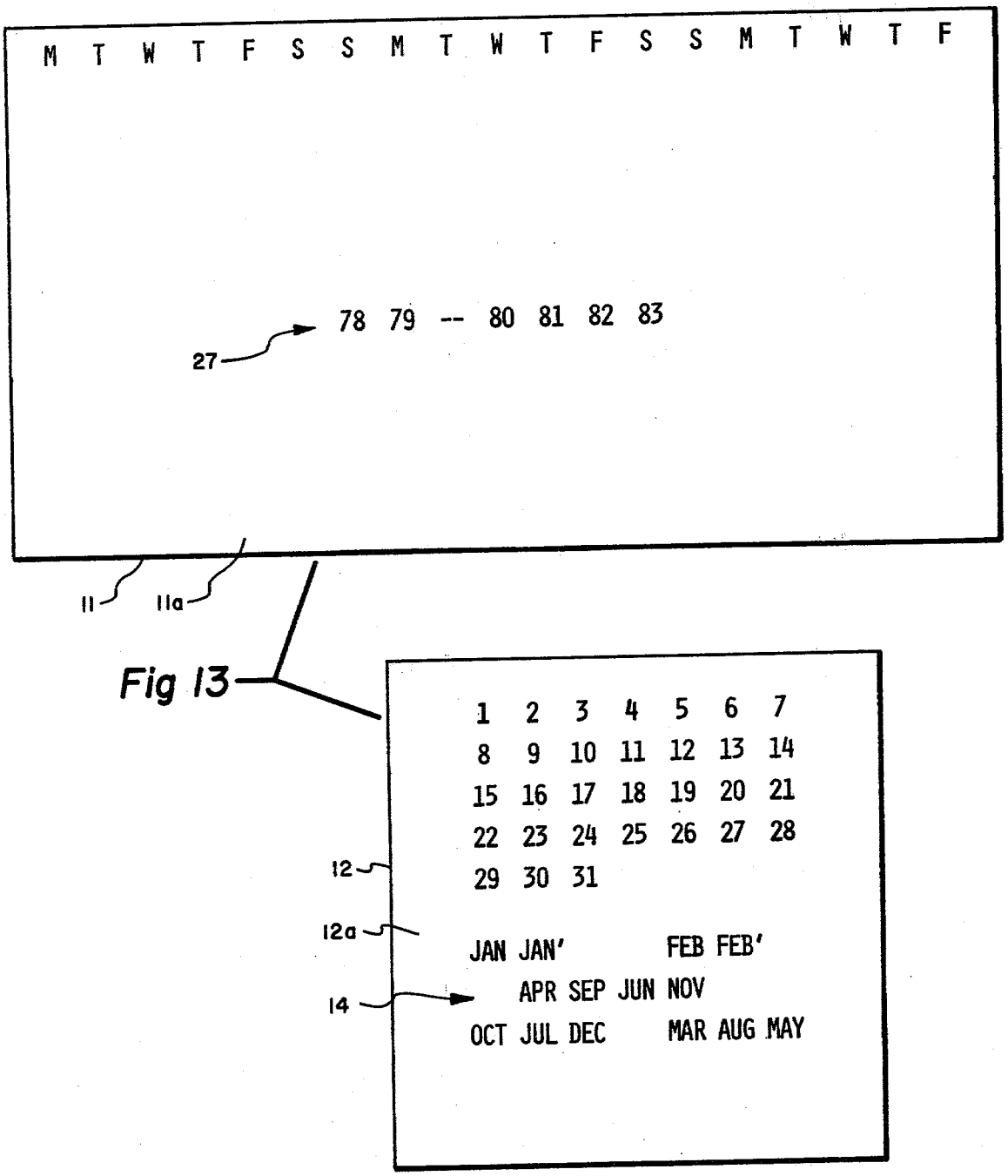
Figure 14:
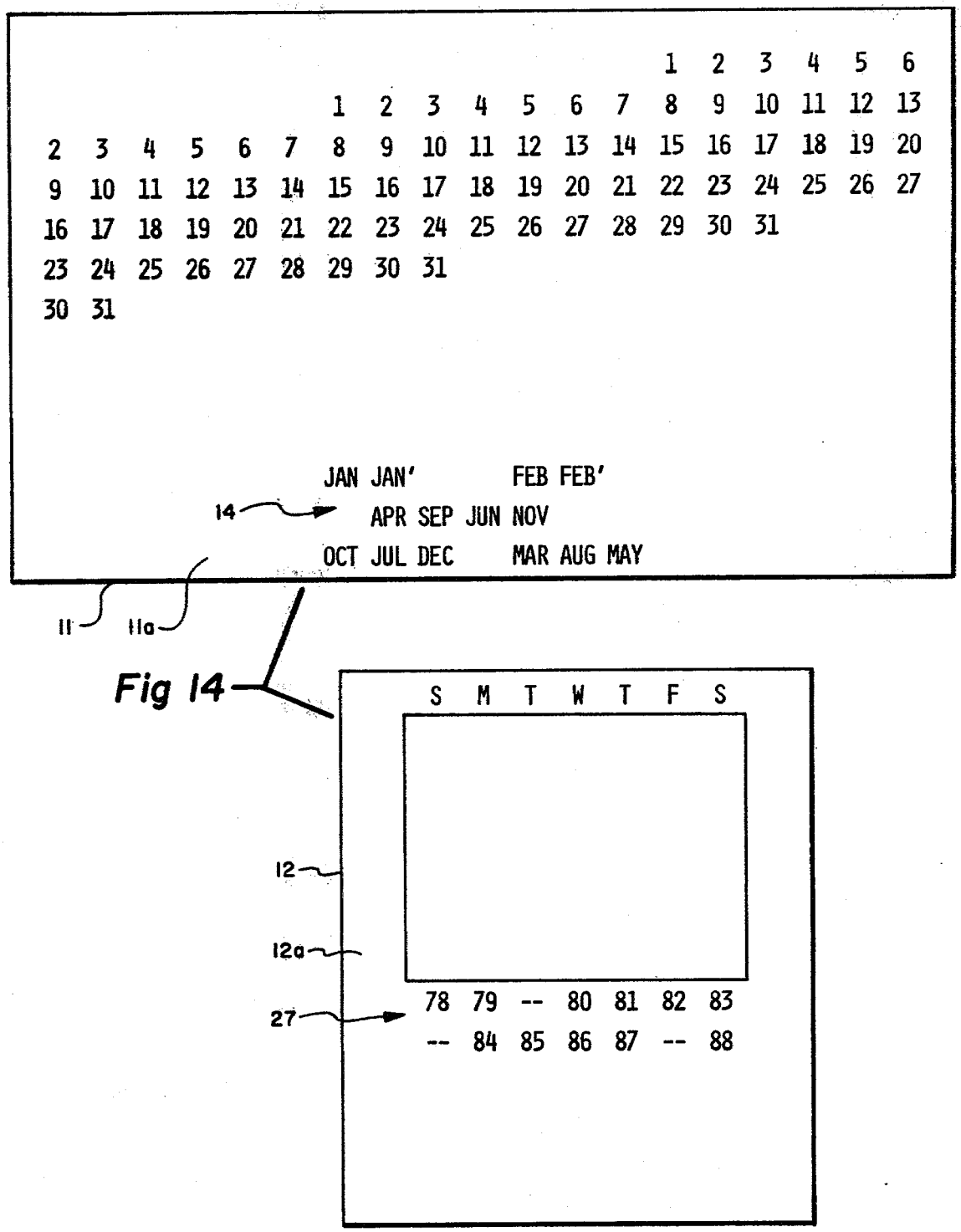
Figure 15:
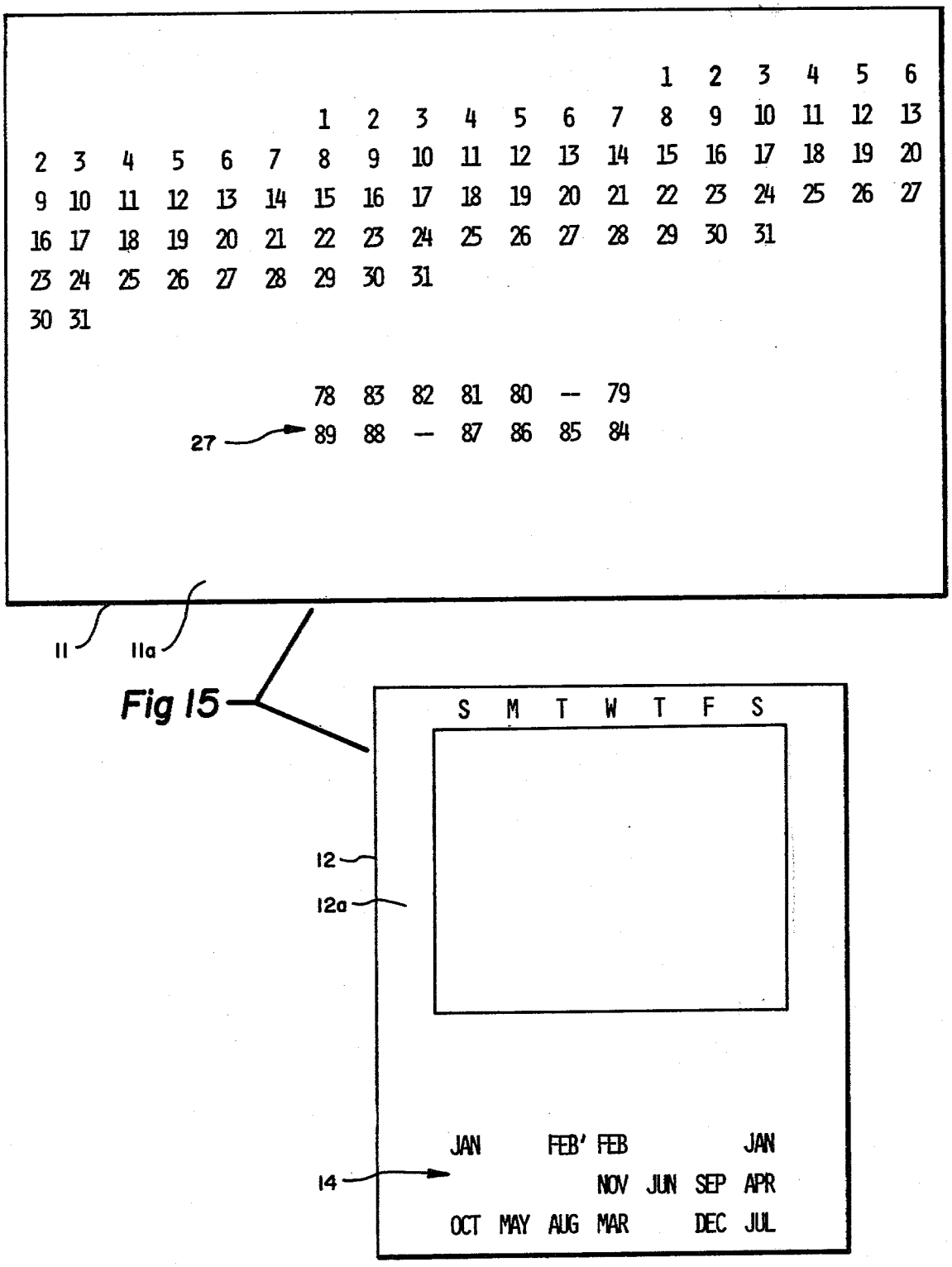
Figure 17:
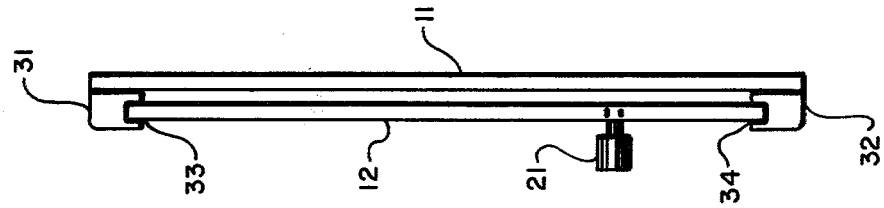
Figure 16:
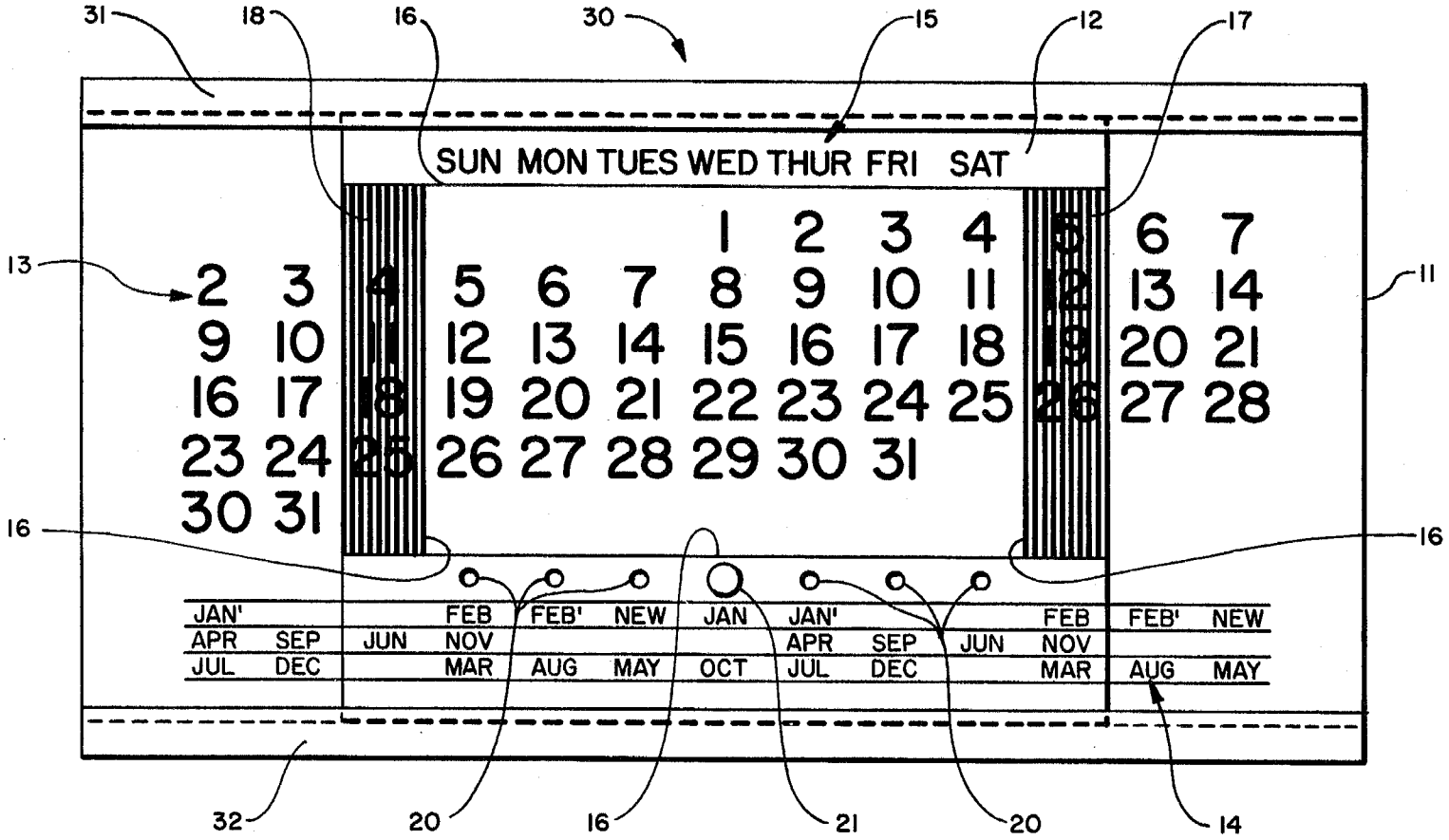
Figure 19:
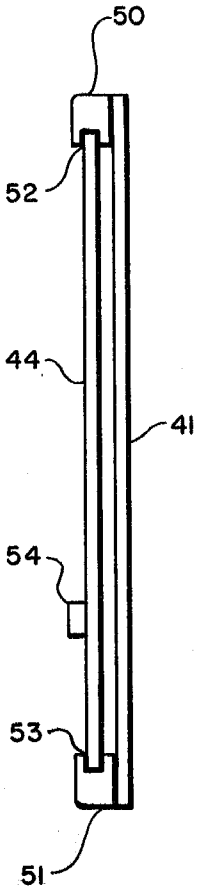
Figure 18:
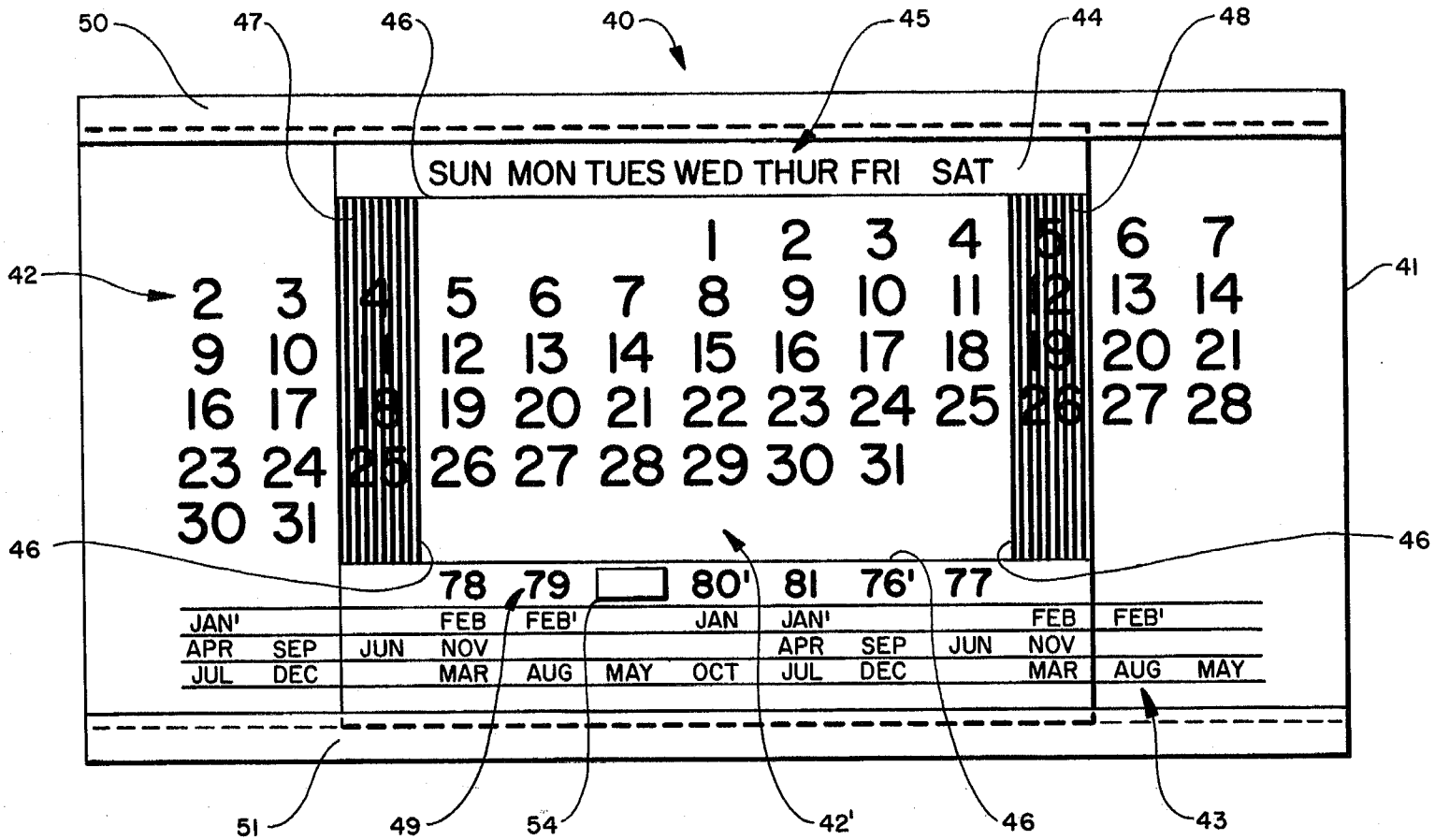
Figure 21:
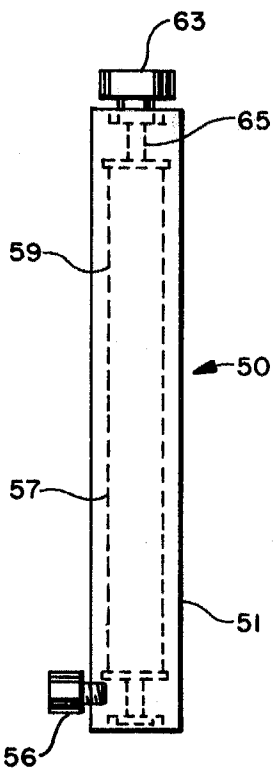
Figure 22:
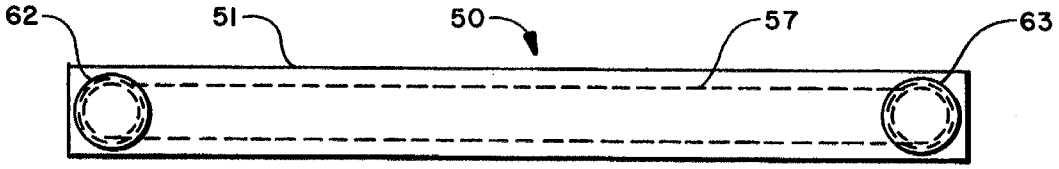
Figure 20:
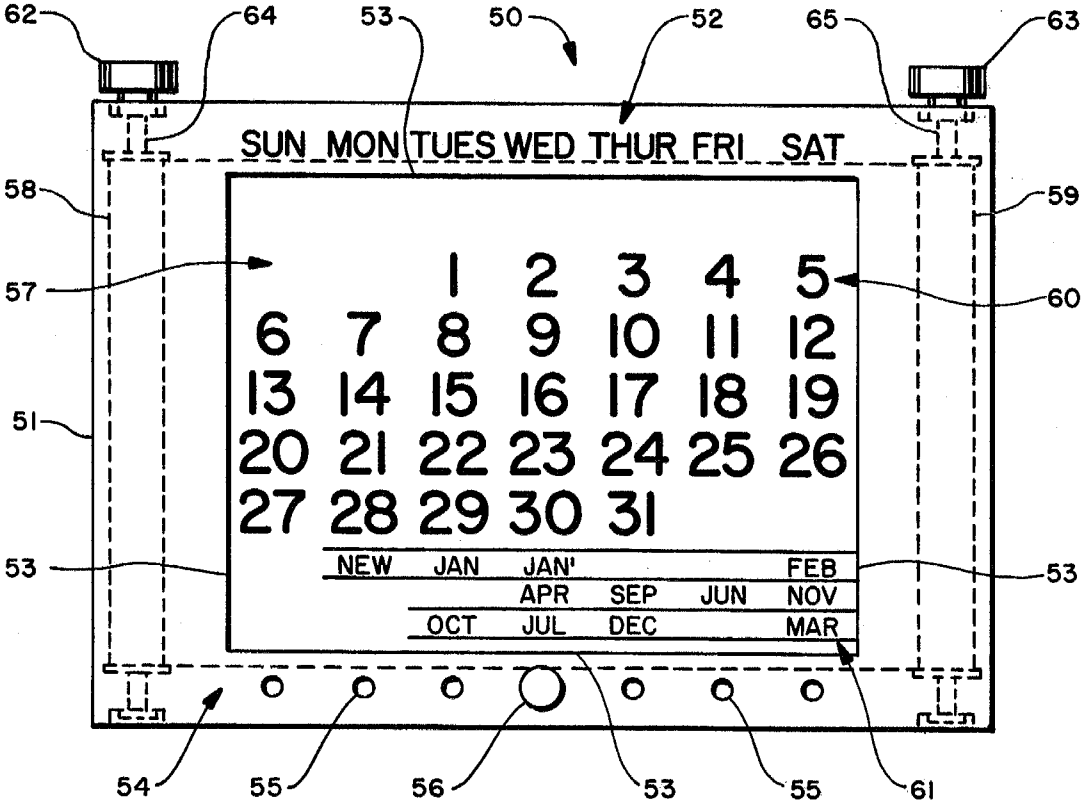
Figure 25:
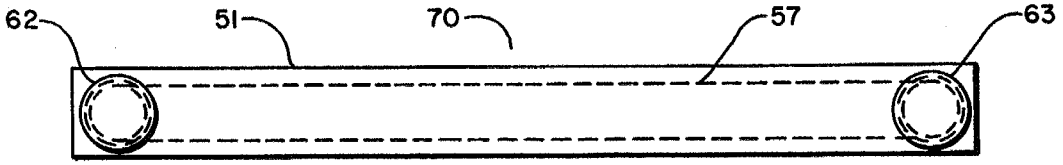
Figure 23:
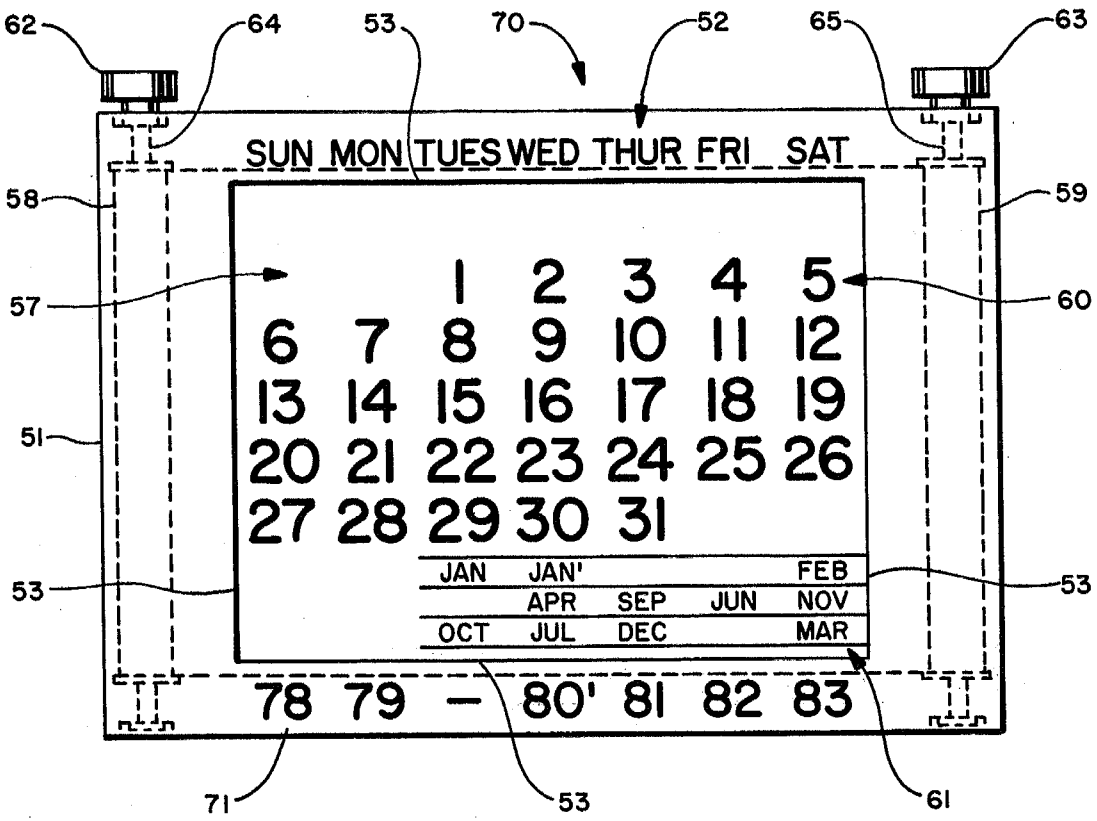
Figure 24:
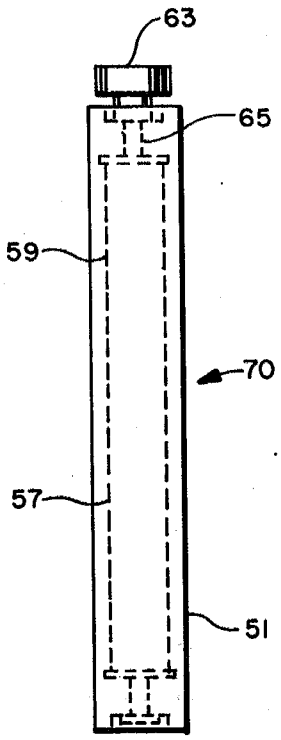
Figure 27:
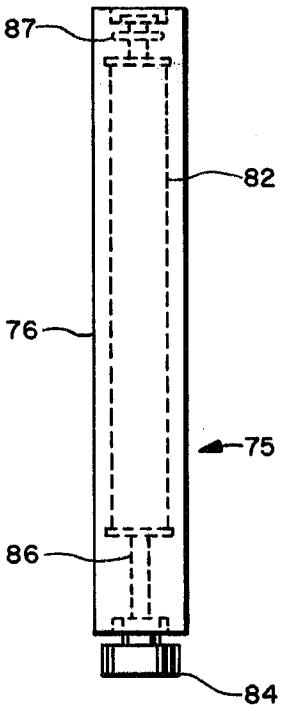
Figure 28:
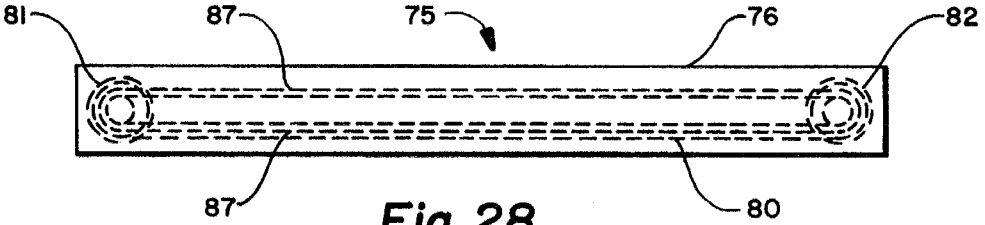
Figure 26:
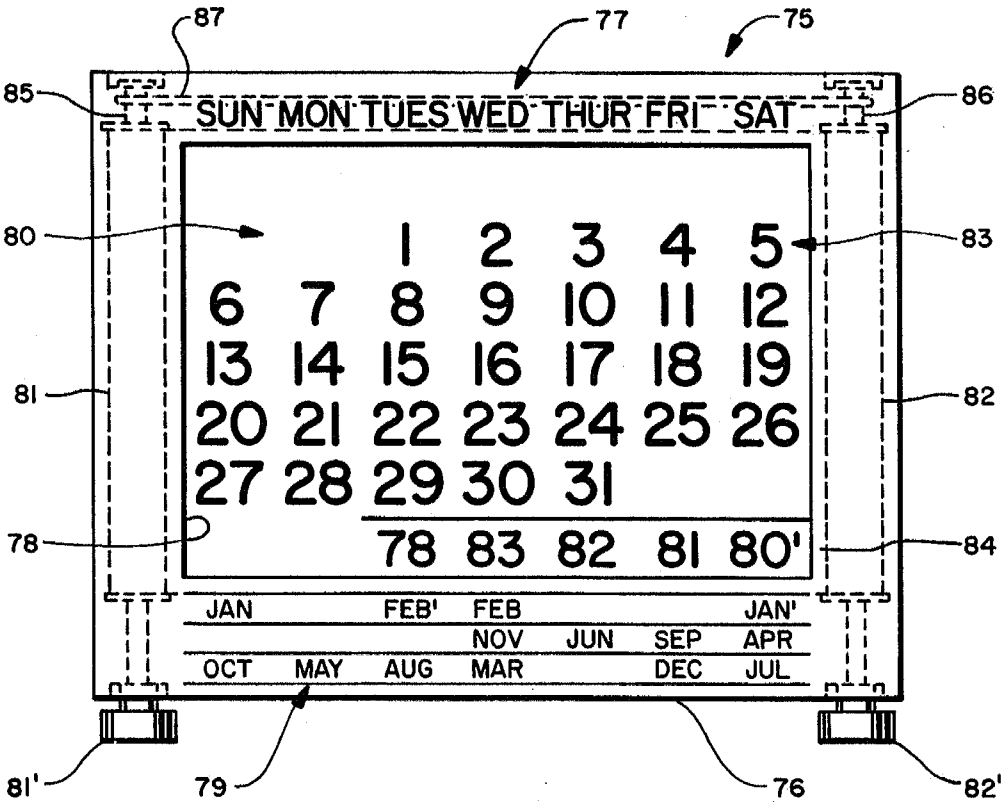
Figures 29, 30, 31:
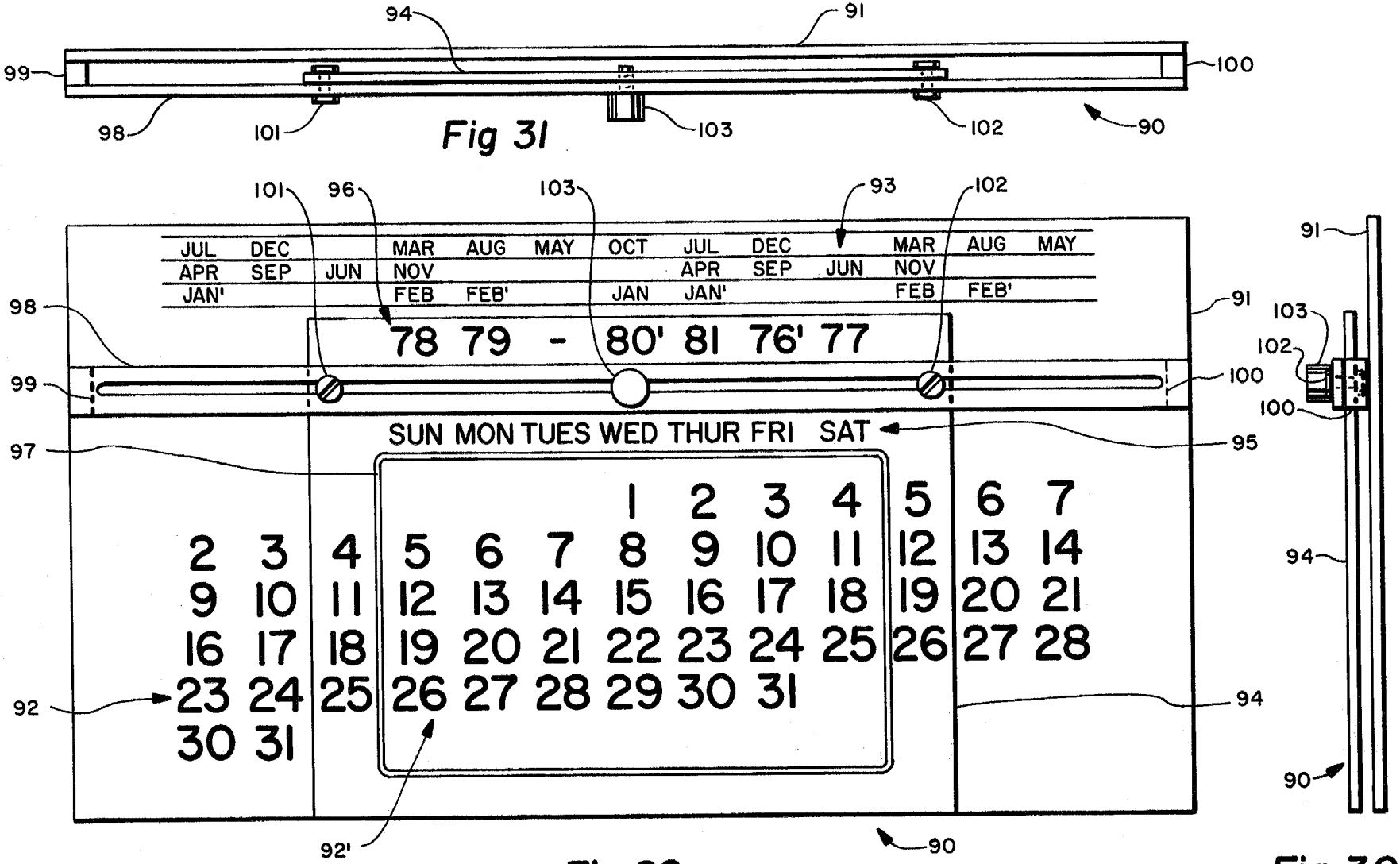

FIG. 4 is a diagrammatic representation of perpetual calendar design IV according to a preferred embodiment of my subject invention;

FIG. 5 is a diagrammatic representation of perpetual calendar design V according to a preferred embodiment of my subject invention;

FIG. 6 is a diagrammatic representation of perpetual calendar design VI according to a preferred embodiment of my subject invention;

FIG. 7 is a diagrammatic representation of perpetual calendar design VII according to a preferred embodiment of my subject invention;

FIG. 8 is a diagrammatic representation of perpetual calendar design VIII according to a preferred embodiment of my subject invention;

FIG. 9 is an illustration of procedure for determining index position for a new year according to a preferred embodiment of my subject invention;

FIG. 10 is a diagrammatic representation of multi-year calendar design I-M adapted from perpetual calendar design I according to a preferred embodiment of my subject invention;

FIG. 11*a* to *e* are diagrammatic representations of multi-year calendar design III-M adapted from perpetual calendar design III according to a preferred embodiment of my subject invention;

FIG. 12 is a diagrammatic representation of multi-year calendar design V-M adapted from perpetual calendar design V according to a preferred embodiment of my subject invention;

FIG. 13 is a diagrammatic representation of multi-year calendar design VI-M adapted from perpetual calendar design VI according to a preferred embodiment of my subject invention;

FIG. 14 is a diagrammatic representation of multi-year calendar design VII-M adapted from perpetual calendar design VII according to a preferred embodiment of my subject invention;

FIG. 15 is a diagrammatic representation of multi-year calendar design VIII-M adapted from perpetual calendar design VIII according to a preferred embodiment of my subject invention;

FIGS. 16 and 17 are an elevation and a side view, respectively, of another calendar device based on perpetual calendar design III according to a preferred embodiment of my subject invention;

FIGS. 18 and 19 are an elevation and a side view, respectively, of another calendar device based on multi-year calendar design III-M according to a preferred embodiment of my subject invention;

FIG. 20 is an elevation of a calendar device based on perpetual calendar design VII accordng to a preferred embodiment of my subject invention;

FIG. 21 is a side view of the calendar device of FIG. 20;

FIG. 22 is a top view of the calendar device of FIG. 20;

FIGS. 23, 24 and 25 are an elevation, side view and top view, respectively, of a calendar device based on multi-year calendar design VII-M according to a preferred embodiment of my subject invention;

FIGS. 26, 27 and 28 are an elevation, side view and top view, respectively, of a calendar device based on multi-year calendar design VIII-M according to a preferred embodiment of my subject invention;

FIGS. 29, 30 and 31 are an elevation, side view and top view, respectively, of a calendar device based on multi-year calendar design III-M according to a preferred embodiment of my subject invention.

Figure 33A:
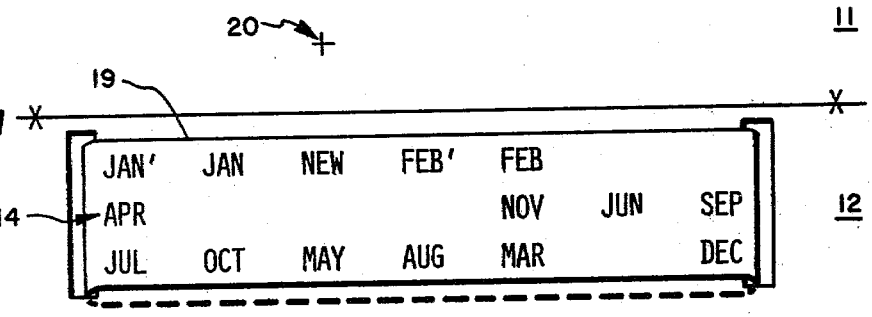
Figure 33B:
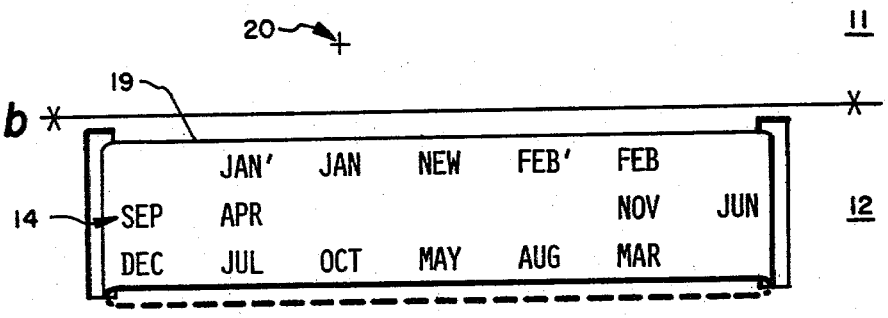
Figure 33C:
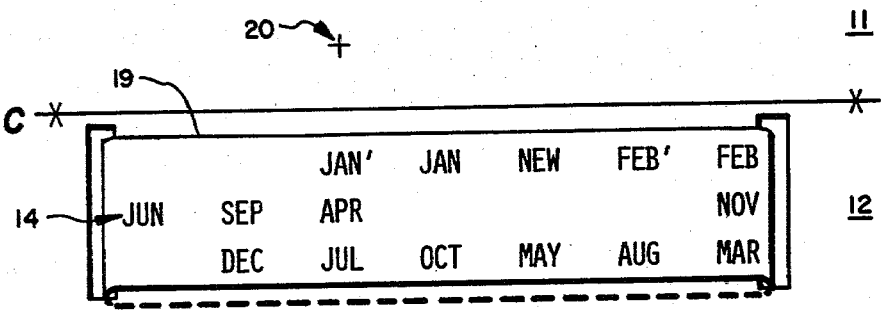
Figure 34:
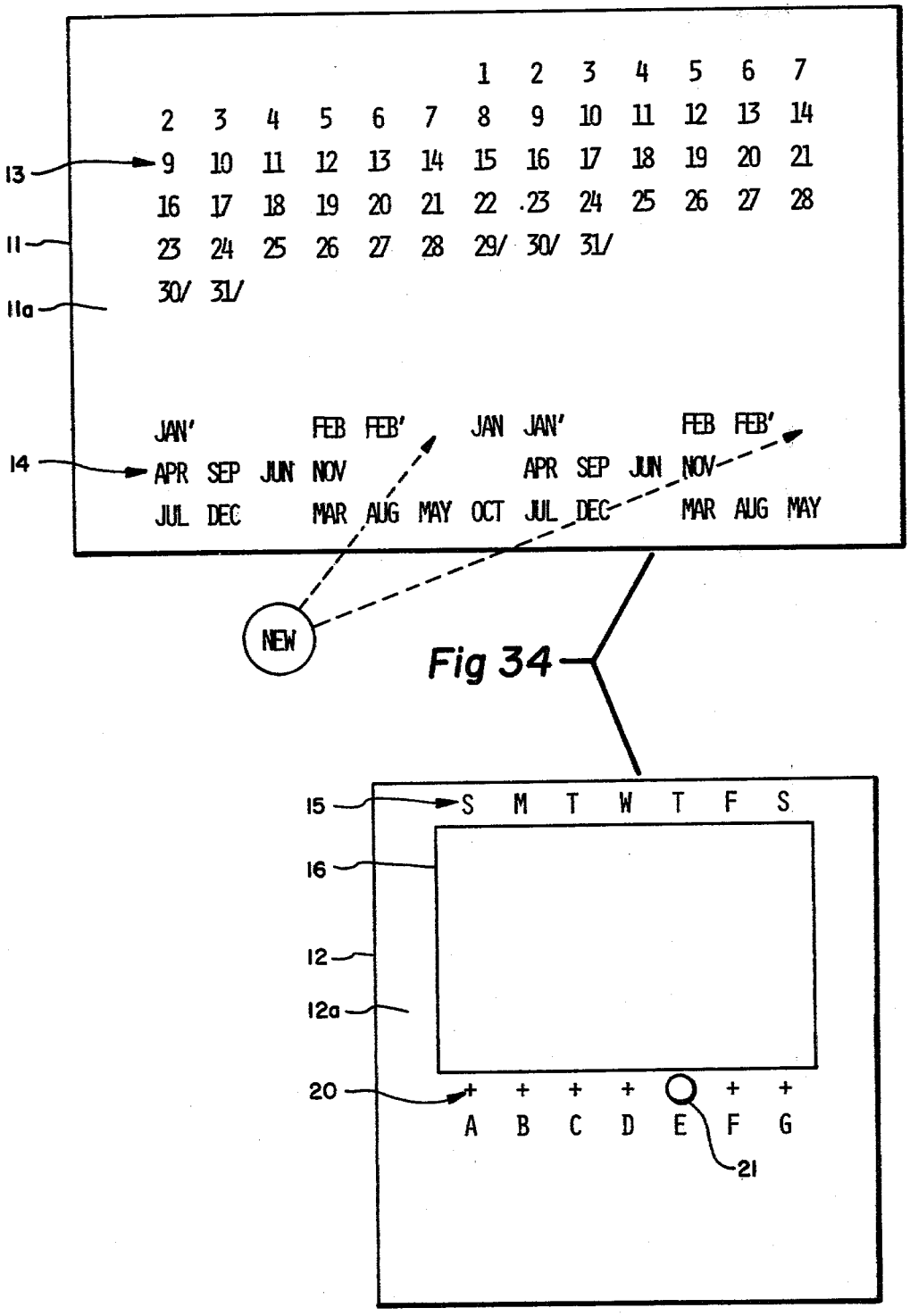

FIG. 32 is a diagrammatic representation of perpetual calendar design IX according to a preferred embodiment of my subject invention;

FIGS. 33*a* to *c* are illustrations of a procedure for determining the order of the columns of the third calendar data for a new year according to a preferred embodiment of my subject invention; and FIG. 34 is a diagrammatic representation of calendar design X according to a preferred embodiment of my subject invention, as well as a diagrammatic representation of perpetual calendar design III according to a preferred embodiment of my subject invention, showing the relationship between the two calendar designs.

DESCRIPTION OF PREFERRED EMBODIMENTS

In accordance with a preferred embodiment of my subject invention, I develop calendar components on the basis of the following procedures and considerations.

In particular, I establish first and second means, bearing the display surfaces on which the calendar components are located, as will be more fully disclosed in connection with FIGS. 16 et seq. When two calendar data components are paired (put together) on the same means, i.e., one of the first two calendar data and one of the calendar setting components, the two data components can be put on the same surface, such as by being put on the same panel, or they may be put on separate surfaces which are not contiguous as long as the paired calendar data components maintain a fixed relationship to each other in calendar setting.

The basic unit for all data components is the singly listed set of seven columns or seven positions. In a singly listed set each data element included in the data set is listed only once. The columns of data will be in a cyclical sequence so that the first column can follow the seventh column to begin another cycle. The difference between two adjacent columns or two adjacent positions is equivalent to a difference of a day.

In order to display a complete monthly calendar at each of the seven relative positions of the first and second means, one set of the first two calendar data is singly listed and the other set, multiply listed.

Multiply listed calendar data sets are constructed by placing more than one set of the same singly listed calendar data set side by side so that the data elements in each row can be read from one (singly listed) set or cycle to another without break in sequence. The last set or cycle does not have to be complete.

In the following tables are assembled different structures of the first two calendar data, the third calendar data comprising indications of the months of the year, and the indexing means from which selections can be made to put together various calendar designs.

SELECTION TABLE I.

Singly Listed Calendar Data Comprising Indications of the Days of the Week by Name or Abbreviations Thereof.

| | | | | | | | |
|---|---|---|---|---|---|---|---|
| a. | Sunday | Monday | Tuesday | Wednesday | Thursday | Friday | Saturday |
| b. | Sun | Mon | Tues | Wed | Thurs | Fri | Sat |
| c. | S | M | T | W | T | F | S |

In some calendar designs, Monday, instead of Sunday, is made the first day of the week, and such and other designs are also within the scope of my invention.

SELECTION TABLE II.

Singly Listed Calendar Data Comprising Indications of the Days of the Month by Number of Seven (7) Columns

| | | | | | | | |
|---|---|---|---|---|---|---|---|
| a. | 1 | 2 | 3 | 4 | 5 | 6 | 7 |
| | 8 | 9 | 10 | 11 | 12 | 13 | 14 |
| | 15 | 16 | 17 | 18 | 19 | 20 | 21 |
| | 22 | 23 | 24 | 25 | 26 | 27 | 28 |
| | 29 | 30 | 31 | | | | |
| b. | | | | 1 | 2 | 3 | 4 |
| | 5 | 6 | 7 | 8 | 9 | 10 | 11 |
| | 12 | 13 | 14 | 15 | 16 | 17 | 18 |
| | 19 | 20 | 21 | 22 | 23 | 24 | 25 |
| | 26 | 27 | 28 | 29 | 30 | 31 | |

The above two arrays of numbers are equivalent. The choice is a matter of preference.

The first two calendar data are multiply listed in thirteen (13) or in nineteen (19) columns.

SELECTION TABLE III.

Multiply Listed First Two Calendar Data Sets of Thirteen (13) Columns.

| a. | Mon | Tue | Wed | Thu | Fri | Sat | Sun | Mon | Tue | Wed | Thu | Fri | Sat |
|---|---|---|---|---|---|---|---|---|---|---|---|---|---|
| | | | | | | | 1 | 2 | 3 | 4 | 5 | 6 | 7 |
| | 2 | 3 | 4 | 5 | 6 | 7 | 8 | 9 | 10 | 11 | 12 | 13 | 14 |
| | 9 | 10 | 11 | 12 | 13 | 14 | 15 | 16 | 17 | 18 | 19 | 20 | 21 |
| | 16 | 17 | 18 | 19 | 20 | 21 | 22 | 23 | 24 | 25 | 26 | 27 | 28 |

SELECTION TABLE III.-continued

| | | | Multiply Listed First Two Calendar Data Sets of Thirteen (13) Columns. | | | | | | | | | | |
|---|---|---|---|---|---|---|---|---|---|---|---|---|---|
| a. | Mon | Tue | Wed | Thu | Fri | Sat | Sun | Mon | Tue | Wed | Thu | Fri | Sat |
| | 23 | 24 | 25 | 26 | 27 | 28 | 29 | 30 | 31 | | | | |
| | 30 | 31 | | | | | | | | | | | |

SELECTION TABLE IV.

| | | | Multiply Listed First Two Calendar Data Sets of Nineteen (19) Columns. | | | | | | | | | | | | | | | | |
|---|---|---|---|---|---|---|---|---|---|---|---|---|---|---|---|---|---|---|---|
| a. | M | T | W | T | F | S | S | M | T | W | T | F | S | S | M | T | W | T | F |
| b. | | | | | | | | | | | | | | 1 | 2 | 3 | 4 | 5 | 6 |
| | | | | | | | 1 | 2 | 3 | 4 | 5 | 6 | 7 | 8 | 9 | 10 | 11 | 12 | 13 |
| | 2 | 3 | 4 | 5 | 6 | 7 | 8 | 9 | 10 | 11 | 12 | 13 | 14 | 15 | 16 | 17 | 18 | 19 | 20 |
| | 9 | 10 | 11 | 12 | 13 | 14 | 15 | 16 | 17 | 18 | 19 | 20 | 21 | 22 | 23 | 24 | 25 | 26 | 27 |
| | 16 | 17 | 18 | 19 | 20 | 21 | 22 | 23 | 24 | 25 | 26 | 27 | 28 | 29 | 30 | 31 | | | |
| | 23 | 24 | 25 | 26 | 27 | 28 | 29 | 30 | 31 | | | | | | | | | | |
| | 30 | 31 | | | | | | | | | | | | | | | | | |

Like the first two calendar data, the third calendar data and the indexing means can be singly and multiply listed. However, the calendar setting components have an additional feature.

Unlike the first two calendar data in which the data elements are in a left-to-right (right-reading) sequence, the third calendar data can be either in a right-reading or a left-reading sequence, while the index may be moved, depending upon calendar design, in a general direction to the right or to the left in adjusting its position each year.

When the number of columns in the multiply listed data of the first two calendar data is 13, the required number of columns for the calendar setting component put on the same means is also 13. As the number of columns is increased, the required number of columns for the accompanying calendar setting component decreases as follows:

| | No. of columns multiply listed one of first two calendar data | No. of columns calendar setting component on the same means |
|---|---|---|
| Preferred | 13 | 13 |
| | 14 | 12 |
| | 15 | 11 |
| | 16 | 10 |
| | 17 | 9 |
| | 18 | 8 |
| Preferred | 19 | 7 |

At 19 columns, the required number of columns in the calendar setting component on the same means is a single listing of 7 columns.

In accordance with a preferred embodiment, the multiply listed data of the first two calendar data of 13 columns is provided on a stationary, flat means. The multiply listed calendar data of 19 columns and its accompanying singly listed calendar setting component of 7 columns is preferably provided on a movable, flexible means. The reason for this preference is that with the 13-column calendar data, very often, the column for the next month, visible in the calendar display, may not be the one to be lined up with the index for next month's calendar. The proper column may be the duplicate one rolled up or hidden in the back. In this case, the direction in which to move the flexible means will not be clearly indicated, causing a little confusion in calendar setting. This problem does not arise with a singly listed calendar setting component accompanying a 19-column array of one of the first two calendar data.

The multiply listed one of the first two calendar data in an endless configuration can only have a number of columns which is a multiple of seven (7) - 14, 21, 28, 35, etc. The accompanying calendar setting component on the same means will have the same number of columns as the multiply listed one of the first two calendar data.

SELECTION TABLE V.

| | Singly Listed Third Calendar Data Comprising Indications of the Months of the Year Including Indication of January of a New Year in (a) a Right-Reading Sequence and (b) a Left-Reading Sequence. | | | | | | |
|---|---|---|---|---|---|---|---|
| a. | JAN | NEW | FEB' | FEB | | | JAN' |
| | | | | NOV | JUN | SEP | APR |
| | OCT | MAY | AUG | MAR | | DEC | JUL |
| b. | JAN' | | | FEB | FEB' | NEW | JAN |
| | APR | SEP | JUN | NOV | | | |
| | JUL | DEC | | MAR | AUG | MAY | OCT |

The left-reading sequence is a mirror image, positionwise, of the right-reading sequence.

SELECTION TABLE VI.

| | Multiply Listed Third Calendar Data Comprising Indications of the Months of the Year and Including an Indication of January of a New Year in (a) a Right-Reading Sequence and (b) a Left-Reading Sequence. | | | | | | | | | | | | |
|---|---|---|---|---|---|---|---|---|---|---|---|---|---|
| a. | NEW | FEB' | FEB | | | JAN' | JAN | NEW | FEB' | FEB | | | JAN' |
| | | | NOV | JUN | SEP | APR | | | | NOV | JUN | SEP | APR |
| | MAY | AUG | MAR | | DEC | JUL | OCT | MAY | AUG | MAR | | DEC | JUL |
| b. | JAN | | | FEB | FEB' | NEW | JAN | JAN' | | | FEB | FEB' | NEW |

SELECTION TABLE VI.-continued

| Multiply Listed Third Calendar Data Comprising Indications of the Months of the Year and Including an Indication of January of a New Year in (a) a Right-Reading Sequence and (b) a Left-Reading Sequence. | | | | | | | | | | | | |
|---|---|---|---|---|---|---|---|---|---|---|---|---|
| APR JUL | SEP DEC | JUN | NOV MAR | AUG | MAY | OCT | APR JUL | SEP DEC | JUN | NOV MAR | AUG | MAY |

In connection with the name of a month or its abbreviation, a prime mark (') identifies the January and February indications to be used only in a leap year. In a leap year, the index is aligned with JAN' and FEB' instead of JAN and FEB, respectively. JAN and FEB, without prime mark are the indications for these months in a common year. Of course, the special locations of January and February in a leap year can be distinguished and identified in a number of other ways than with a prime mark.

In constructing the third calendar data set, starting with the indication of January, the indication of each successive month is located on a seven-column scale, zero (0), one (1), two (2), or three (3) columns to the right (to the right in a right-reading sequence, to the left in a left-reading sequence) of the indication of the previous month according to the length of the previous month being twenty-eight (28), twenty-nine (29), thirty (30), or thirty-one (31) days, respectively.

The indication of January of a new year (NEW for new year) is located in the same way as the indications of the months—by counting off three columns (to the right in a right-reading sequence, to the left in a left-reading sequence) from the indication of December, which month has thirty-one (31) days.

The columns are in a cyclic sequence so that the first column can follow the seventh to start a new cycle in multiply listing the third calendar data.

SELECTION TABLE VII.

| (a) Singly Listed Indexing Means (b) Multiply Listed Indexing Means | | | | | | | | | | | | |
|---|---|---|---|---|---|---|---|---|---|---|---|---|
| a. | + | + | + | + | + | + | O | | | | | |
| b. | + | + | + | + | + | O | + | + | + | + | + | + | O |

Unoccupied index positions are represented by + and the position occupied by the movable index element by 0.

Singly listed indexing means comprise a set of seven index positions and a movable index element locatable at any one of these positions.

Multiply listed indexing means comprise thirteen index positions, i.e., a set of seven index positions plus duplicates of six of these positions, each duplicate being seven positions apart from the other, and two movable index elements, which are also duplicates, seven positions apart. Each of these index elements moves over its own set of index positions.

The columns in all of the calendar data sets are in a cyclical sequence so that any column in a data set can be the first column in the sequence. The arrangements of the columns in the various selection tables shown above are the preferred ones.

The indications of the months of the year included in the third calendar data are arranged to supply an extra bit of information. The four months of the year which have thirty days are listed in the middle or second row. All the months which are listed in the bottom or third row have thirty-one days. The indications of January and February, which have special locations for a leap year, are listed in the top or first row. January has thirty-one days and February has twenty-eight days in a common year, twenty-nine days in a leap year.

By way of general overview, my calendar designs each comprise four (4) calendar data components and two (2) means or panels, one of which is movable relative to the other. The two means or panels bear the calendar data components as follows:

1. Calendar data comprising indications of the days of the week by name, [W];
2. Calendar data comprising indications of the days of the month by number, [D];
3. Calendar data comprising indications of the months of the year by name, [M]; and
4. Indexing means, [X].

The first two calendar data, [W] and [D], jointly display the monthly calendars. [M] and [X] are the two calendar setting components. The calendar for any month of the year is set by aligning an index in [X], at its position for the year, with the column for the month in [M].

A selection (A or B) is made for each of the following five pairs of alternatives or options:

(i) Pairing

[W] and [D] are put on separate means or panels.

[M] and [X] are put on separate means. This results in two possible pairing of the four components.

A. [W] and [M] are paired on one of the first and second means: [D] and [X] are paired on the other of the first and second means.

B. [W] and [X] are paired on one of the first and second means; [D] and [M] are paired on the other of the first and second means.

(ii) Single and Multiple Listing

There are seven possible relationship between [W] and [D]. To show this in calendar displays, it is necessary that one of the first two calendar data be singly listed and that the other, be multiply listed.

A. [W] singly listed and [D] multiply listed.

B. [W] multiply listed and [D] singly listed.

Selection of A or B determines the calendar display format. Selection A gives the familiar format in which Sunday (or Monday) is always the first column.

(iii) Configuration of Multiply Listed [W] or [D]

A. Multiply listed [W] or [D] have left and right [L and R] margins.

B. Multiply listed [W] or [D] are in an endless configuration.

Selection is made from two possible configurations for multiply listed [W] or [D].

In this respect, calendar data in an endless configuration should not be confused with endless calendar data display bands and the like. Multiply listed calendar data component with [L and R] margins may be put on rigid means having [L and R] edges or on endless data display means. Multiply listed calendar data component in an endless configuration will be put on means in an endless configuration.

(iv) Adjustment in the Position of One of Calendar Setting Components, [M] or [X], Each New Year The position of the index in [X] and the columns of the months in [M] relative to each other has to be changed each year. There are two ways of doing this.

A. The index is moved for the new year while the month columns in [M] remain fixed.

B. The month columns in [M] are moved for the new year while the index remains fixed.

(v) Indexing Means

A. The indexing means comprise a movable index element and a scale of index positions ]Perpetual calendar[.

B. The indexing means comprise calendar data comprising indications of the years by number. [Multi-year calendar].

The designs with Selection A, the user determines the position of the index for each new year. Since these positions are not pre-determined, the calendar design is perpetual.

With Selection B, the index positions for successive years are predetermined and imprinted so that the calendar is multi-year, limited to the years for which the index positions have been imprinted.

In principle, 2×2×2×2×2 or 32 basic designs (16 perpetual and 16 multi-year) are derivable from these five pairs of alternatives. Presently preferred calendar designs include the following selections: i-A and i-B; ii-A and ii-B; iii-A, iv-A, v-A and v-B. Another feasible selection includes selection iii-B (multiply listed calendar data in an endless configuration). Selection iv-B (adjustment by moving the month columns in [M] for the new year while keeping the index fixed) is also preferred.

The selection in each of the five pairs of alternatives can be used as a descriptor, five descriptors defining a complete calendar design.

The adequacy of five descriptors to define a calendar design is indicated by the fact that we can classify or categorize prior art calendars (of the calendar setting type) with descriptors in a manner which distinguishes one from the other.

a. Lauer, U.S. Pat. No. 1,558,020 [ii-A, ii-A, iii-A, iv-B, v-B]

Zabriskie, U.S. Pat. No. 1,073,206 [i-A, ii-A, iii-A, iv-A, v-B]

c. Calendars on Wittnauer, [-B, ii-B, iii-B, iv-A, v-B] Neuvex wrist watches; calendar of Anderson & Sons d. My preferred desk calendar [i-B, ii-A, iii-A, iv-A, v-A]

However, Lauer did not have the concept of calendar data comprising indications of the years and so his calendar is only good for three years with three full [M]'s imprinted. Zabriskie pairs [W] and [M] on the same means but separates [D] and [X] instead of putting them on the same means, making calendar setting more cumbersome than necessary.

The following practical procedure is used to build up perpetual calendar designs with a first and a second means or first and second panels and the four calendar data components. The actual calendar data sets are selected from Selection Tables I–VII.

1. Choose one of first two calendar data for single listing and the other of first two calendar data for multiply listing. Take singly listed calendar data from Selection Tables I or II. 2. Choose between multiply listed other of first two calendar data of thirteen (13) columns and nineteen (19) columns. Take multiply listed calendar data of thirteen (13) columns from Selection Table III, multiply listed calendar data of nineteen (19) columns from Selection Table IV.

3. Decide which of the calendar setting components—the indexing means and the third calendar data comprising indications of the months of the year—is to be paired on the same means with the singly listed one of the first two calendar data and which other is to be paired on the same other means with the multiply listed other of the first two calendar data.

4. The calendar setting component on the same means with the singly listed one of the first two calendar data will also be singly listed. Pick from Selection Table V or VII.

5. The calendar setting component paired on the same other means with the multiply listed other of the first two calendar data of thirteen (13) columns will be multiply listed in thirteen columns. Pick from Selection Table VI or VII.

6. The calendar setting component paired on the same other means with the multiply listed other of the first two calendar data of nineteen (19) columns will be singly listed. Pick from Selection Table V or VII.

7. Put one of the selected pair of data components on the first means or panel and the other selected pair of data components on the second means or panel.

The eight basic designs which result from the procedure given above are summarized in Tables VIII and IX and are diagrammatically illustrated in FIGS. 1–8. In particular, FIGS. 1 to 8 show diagrammatically (a) the dispositions of the four calendar components on the first and second means and (b) the structure (the number of columns or positions) of each of these components in eight basic perpetual calendar designs. The eight designs are summarized in Tables VIII and IX. The above two attributes adequately define a calendar design such that each design is distinguishable from the others in this group of eight.

TABLE VIII.

Calendar Designs with Multiply Listed One of the First Two Calendar Data of Thirteen (13) Columns.

| Design Number | Components on one of first & second means | Components on other of first & second means |
|---|---|---|
| I | $W_m$ (13 columns) | $D_s$ (7 columns) |
| | $M_m$ (13 columns) | $X_s$ (7 positions) |
| II | $W_m$ (13 columns) | $D_s$ (7 columns) |
| | $X_m$ (13 positions) | $M_s$ (7 columns) |
| III | $D_m$ (13 columns) | $W_s$ (7 columns) |
| | $M_m$ (13 columns) | $X_s$ (7 positions) |
| IV | $D_m$ (13 columns) | $W_s$ (7 columns) |
| | $X_m$ (13 positions) | $M_s$ (7 columns) |

Legend:

W=calendar data comprising indications of the days of the week by name.

D=calendar data comprising indications of the days of the month by number.

M=third calendar data comprising indications of the months of the year and including an indication of January of a new year.

X=indexing means m=multiply listed s=singly listed

TABLE IX.

| Design | Calendar Designs with Multiply Listed One of the First Two Calendar Data of Nineteen (19) Columns. | |
|---|---|---|
| | Components on one of first & second means | Components on other of first & second means |
| V | $W_m$ (19 columns) | $D_s$ (7 columns) |
| | $M_s$ (7 columns) | $X_s$ (7 positions) |
| VI | $W_m$ (19 columns) | $D_s$ (7 columns) |
| | $X_s$ (7 positions) | $M_s$ (7 columns) |
| VII | $D_m$ (19 columns) | $W_s$ (7 columns) |
| | $M_s$ (7 positions) | $X_s$ (7 positions) |
| VIII | $D_m$ (19 columns) | $W_s$ (7 columns) |
| | $X_s$ (7 positions) | $M_s$ (7 columns) |

The various combinations of the first two calendar data and the two calendar setting components on the first and second means have resulted in a family of perpetual calendar designs. The execution of the various designs has necessitated certain novel structures for the data components such as:

1. Singly listed third calendar data comprising indications of the months of the year in a left-reading sequence;

2. Multiply listed third calendar data in both right-reading and left-reading sequences;

3. Multiply listed one of first two calendar data of nineteen (19) columns which exceeds singly listed other of the first two columns by twelve (12) columns, permitting singly listing for both calendar setting components.

The various resultant calendar designs are themselves novel.

The various calendar designs in accordance with a preferred embodiment are made to be read from left-to-right in each row and top-to-bottom by rows. The four data components can be easily restructured and adapted to yield calendar designs which are read from top-to-bottom in columns going from left-to-right such as in the calendar of Lauer, U.S. Pat. No. 1,558,020.

Certain rules must be observed in assembling or putting together the selected sets of the four calendar data components in a calendar design.

When the number of columns in the multiply listed one of the first two calendar data exceeds that in the singly listed other of the first two calendar data by six (6), then the number of columns (or positions) in one of the calendar setting components should also exceed that in the other of the calendar setting components by six (6). This condition is met with in the multiply listed one of the calendar setting components of thirteen (13) columns or positions and the singly listed other of the calendar setting components of seven (7) positions or columns.

When the number of columns in the multiply listed one of the first two calendar data exceeds that in the singly listed other of the first two calendar data by twelve (12), then both calendar setting components will be singly listed with seven (7) columns or positions.

The third calendar data when paired on the same means with the calendar data comprising indications of the days of the week by name should be in a right-reading sequence when both sets of calendar data are to be viewed from the same side. Likewise, in an indexing means which is paired on the same means as the calendar data comprising indications of the days of the week by name the position of the movable index element is changed each year in a general left-to-right direction.

The third calendar data when paired on the same means with the calendar data comprising indications of the days of the month by number should be in a left-reading sequence when both sets of calendar data are to be viewed from the same side. In an indexing means which is paired on the same means as the calendar data comprising indications of the days of the month by number the position of the movable index element is changed each year in a right-to-left direction.

The calendar setting components can be put on the same (front) surfaces of the means including panels bearing the first two calendar data or they may be put on the back surfaces of the means including panels bearing the first two calendar data.

Even when they are on the same (front) surfaces, the calendar setting components may still be kept apart or separate from the first two calendar data. Or, they may be put together with the first two calendar data such that all of their columns are vertically aligned permanently with the columns of the respective ones of the first two calendar data with which they are paired. In this case, the data columns in each of two paired sets of calendar data are said to be "in registry".

In designs which call for multiple listing of one of the calendar setting components, it is preferred that the multiply listed calendar setting component be paired on the same means or panel with the multiply listed one of the first and second calendar data and the singly listed calendar setting component be paired with the singly listed other of the first and second calendar data.

This means that all the columns of the calendar setting component on one means can be in registry with all the columns of one of the first two calendar data on the same means and all the columns of the other calendar setting component on the other means can be in registry will all the columns of the other of the first two calendar data on that same other means.

It is possible to have paired calendar components on the same means with unequal number of columns. In Designs V–VIII, the multiply listed one of the first two calendar data sets has nineteen (19) columns while the calendar setting component on the same means is singly listed with seven (7) columns. In these cases, the seven columns of the singly listed calendar setting component will be in registry with the middle seven columns (from the seventh to the thirteenth column, inclusive) of the multiply listed set as shown in FIGS. 5–8.

The calendar setting components are said to be "in operative relationship" when the indexing means and the third calendar data are so positioned, separately, on the first and second means bearing the first two calendar data such that aligning the index for each year the indications of the months results in the displays of the calendars of the months.

When the calendar setting components are put on the back surfaces of the panels bearing the first two calendar data on the front, this is equivalent to a rotation of 180° around the vertical axis for the calendar setting components. The effect of this operation is to reverse a right-reading sequence of the third calendar data on the front to a left-reading sequence on the back, and a left-reading sequence of the third calendar data on the front to a right-reading sequence on the back.

In calendar designs in which the indications of the days of the week by name and the indexing means are on the same means (Designs II, III, VI, and VII), it is possible to have the index position for the year vertically aligned with the indication of the day of the week on which the new year begins. Such an alignment can be obtained by putting the 1-column of the indications of the days of the month by number in registry with the January-October column of the third calendar data comprising indications of the months of the year on the other means. With third calendar data which include special locations for January and February in a leap year, the alignment of the index position for the year with the indication of the day of the week on which the new year begins will occur only in common years. In a leap year, the index position will be one column ahead of the column for the day of the week on which the leap year begins.

The new position of the index for a new year in a perpetual calendar is determined by the user, using the current position of the index as the staring point. The index position is changed once a year, at the beginning. The index (index element) is shifted one position from its current one when the change in the year is to a common one, two positions, when the change is to a leap year. The direction of index change is to the right when the corresponding third calendar data are in a left-reading sequence; to the left, when the third calendar data are in a right-reading sequence.

The index positions are in a cyclic sequence, in that the first position follows the seventh. From the seventh position the movable index element moves back at once to the first position to begin another cycle.

The task of determining the new index position and making this change is simplified by having an indication of January of a new year included in the third calendar data. The user can then set the calendar for January of the new year without first making an index position change by aligning the index at its position for the year just past with this indication of January of a new year. The indications of January for a common year and of January for a leap year are located one and two columns away, respectively, from the indication of January of a new year in the third calendar data set. Thus, from its position of alignment with the indication of January of a new year, the index (index element) can be moved one column to the position opposite "JAN" if the new year is a common year, two columns to the position opposite "JAN'" if the new year is a leap year.

The indication of January of a new year makes it possible for the other indications of January to serve as indicators of the extent and direction of index change for a new year. It should be noted in this respect that the indication of January of a new year (NEW) is separate and distinct from an indication of January of the months of the year.

Figure 1:
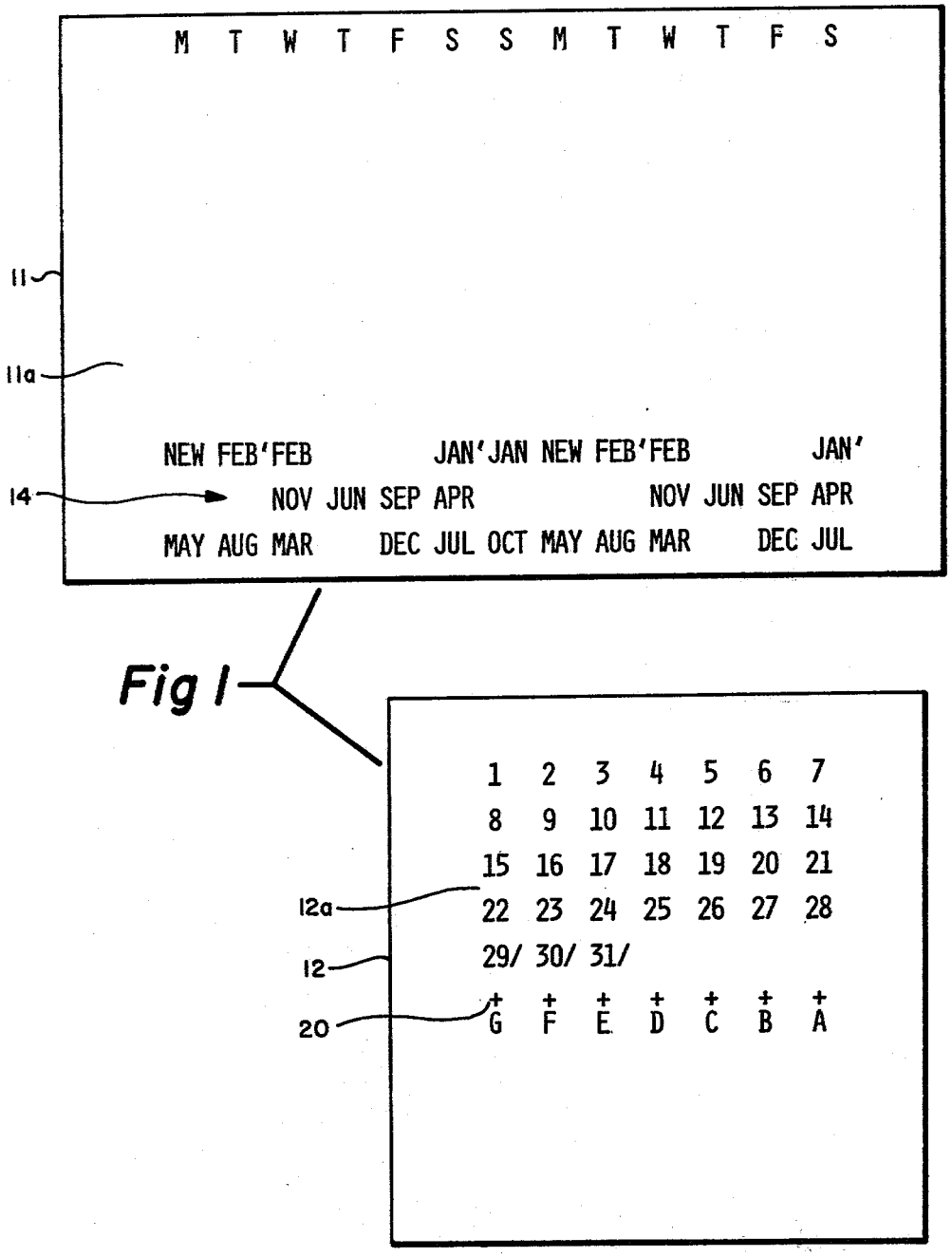
FIG. 1 is a diagrammatic representation of perpetual calendar design I according to a preferred embodiment of my subject invention.

The calendars shown in FIGS. 1 et seq. include two calendar display means or panels, one of which is movable relative to the other. This will now briefly be explained with reference to the explicit views of FIGS. 3*a, b* and *c*.

Referring to FIGS. 3*a* and 3*c*, a perpetual calendar device 10 according to a preferred embodiment of the subject invention and perpetual calendar Design III, includes a panel 11 defining a first display surface 11*a* and a transparent panel 12 defining a second display surface 12*a*. Panel 11 bears on its display surface 11*a* imprinted multiply listed calendar data comprising indications 13 of the days of the month by number, and imprinted multiply listed calendar data comprising indications 14 of the months of the year, including that of January of a new year (NEW). Panel 12 bears on its display surface 12*a* imprinted singly listed calendar data comprising indications 15 of the days of the week by name (i.e. abbreviations thereof), an imprinted rectangular (or square) linear frame 16 for any part of the first display surface 11*a* which includes seven successive columns of the indications 13 of the days of the month by number representing a month's calendar display, and view-obstructing or view-blocking columns 17 and 18, one on each side of frame 16, which obscure from an observer's view the columns of the indications of the days of the month by number immediately adjacent to the seven successive columns pertinent to the month's calendar display. Panel 12 also bears indexing means 19, comprising a set of seven index holes 20, representing a scale of seven index positions, and a movable index knob screw or marker peg 21, representing a movable index element, locatable in or at any one of the seven index holes or positions. A base or mounting member 22 of wood, metal, plastics or another suitable material supports panel 11 in a groove 23 and movably supports panel 12 in a groove 24 for sliding movement of the panel 12 relative to the first display surface 11*a* of the relatively stationary panel 11. Columns of the indications 14 of the months of the year are in registry with the columns of the indications 13 of the days of the month by number on panel 11, and the index holes 20 are in registry with the columns of the indications 15 of the days of the week by name on panel 12.

For each year, the location of the index knob screw 21 at a particular one of the seven index holes is the index position for the year.

There are seven positions of panel 12 in front of panel 11 from which one is selected by alignment of the index knob screw 21 at the proper index hole position for the year with the indication of the month for which the calendar is to be displayed. The indications 14 of the months of the year are in a left-reading sequence. The indications of January and February to be used in a leap year are separate and distinctly identified, such as by an asterisk (*) or prime mark ('), from the indications for these months to be used in a common year. The indications 14 of all the months, except those of January (common year) and October are in duplicates. The multiply listed third calendar data 14 include a January and October column in registry with the number 1-column of the multiply listed calendar data comprising indications of the days of the month by number.

The index knob screw 21 is aligned with the one of the duplicate indications for a month which results in a complete monthly calendar display. The middle column of the indications 14 of the months of the year which includes the indications of January and October is in registry with the 1-column (column comprising the numbers 1, 8, 15, 22, 29) of the indications 13 of the days of the month by number. When screwed into the proper index hole, the index knob screw 21 serves as a convenient handle for manually moving panel 12.

According to FIGS. 3*a* to *c*, the frame 16, with view-obstructing columns 17 and 18, is imprinted or otherwise provided on the movable panel 12 which, for that purpose, is made of a transparent material. Alternatively, the panel 12 could be cut out to provide a free area through which part of the calendar data on the display surface 11*a* of the relatively stationary panel is visible.

An an interesting feature some of the data 13 and 14 remain visible to one or both sides of the panel 12 at different positions of that panel 12 relative to the panel 11; the movable panel 12 being smaller than the panel 11 in the direction of movement of the panel 12 relative to the panel 11. Practical tests have shown that this does not derogate from the utility of the device as a calendar and, to the contrary, removes a certain awkwardness which would come about by attempts to hide constantly all unused parts of the data 13 and 14 in any position of the movable panel 12.

Adjustment of the panel 12 relative to the panel 11 in accordance with different occurring calendar interrelationships of the calendar data 13 and 15 is explained with the aid of FIGS. 3*b* and 9.

In FIG. 9 are shown the indexing means and the third calendar data set on separate means, such as the separate panels 11 and 12 (separation indicated by a line 26).

The index element 21 (before position change) is shown aligned with "NEW", by movement of the panel 12, which sets the January calendar fo the new year; NEW indicating January of the new year, i.e. of the year succeeding the year which up to then has been displayed by the calendar. With the relative positions of the two means kept fixed, the index element 21 is removed from its index position shown in FIG. 9 and is moved one column to the index position 20 above "JAN" when the new year is a common year, or two columns to the index position 20 above "JAN'" when the new year is a leap year. The index element 21 is now in position for the new year.

Comparing FIGS. 3*a* and 3*b* of the drawings, it is seen that FIG. 3*a*, having its index element 21 at the DEC level, displays the month of December of a given year. According to FIG. 3*b*, the panel 12 has been moved until the index element 21 is at the NEW level. Without moving the panel 12 relative to the panel 11, the index element is removed from the hole 20 at D and is inserted at the hole 20 at E if the new year is a common or regular year. On the other hand, if the new year is a leap year, then the index element 21 is moved to the hole at F, as shown in phantom outline at 21'.

The displays of the subsequent months of the year are realized by moving the panel 12 relative to the panel 11 so as to align the index element 21 with each particular month among the third calendar data 14.

In the illustrated preferred embodiment, the indications of the third calendar data 4 include indications of January through December listed successively in selected columns according to their relative day-of-the week beginnings. The indications of the third calendar data 14 further include an indication NEW of January of a new year listed in one of the selected columns according to the length of the month of December.

The index positions are in a cyclic sequence so that the first position follows the seventh. From the seventh position, the movable index element moves back at once to the first position to begin another cycle.

There are two different patterns which are followed by the index as it changes its position each year:

(a) In one, the index moves cyclically over seven index positions.

(b) In the other, the index moves continuously in one direction over a large number (a multiple of seven) index positions.

The pattern which is followed is determined by the one of the first two calendar data with which the indexing means are paired on the same means. In (a), there are left and right margins to the set of the one of the first two calendar data. In (b), the one of the first two calendar data are in an endless configuration.

A structural embodiment of my calendar having been shown in FIGS. 3*a–c*, a more diagrammatic showing has been adopted for FIGS. 1, 2, 4, 5, etc., with the understanding that the same structure may be employed as shown in FIGS. 3*a–c*, if desired.

Perpetual calendar design I is diagrammatically shown in FIG. 1. Calendar data comprising indications of the week by name (abbreviations thereof), multiply listed in thirteen columns and calendar data 14 comprising indications of the months of the year, including that of January of a new year, multiply listed in thirteen columns, are put on one of first and second means, such as on the display surface 11*a* of the above mentioned panel 11, and calendar data comprising indications of the days of the month by number, singly listed in seven columns, and the indexing means comprising seven index positions 20 wherein the movable index element 21 is selectively locatable, are located on the other of the first and second means, such as on the movable panel 12.

Figure 2:
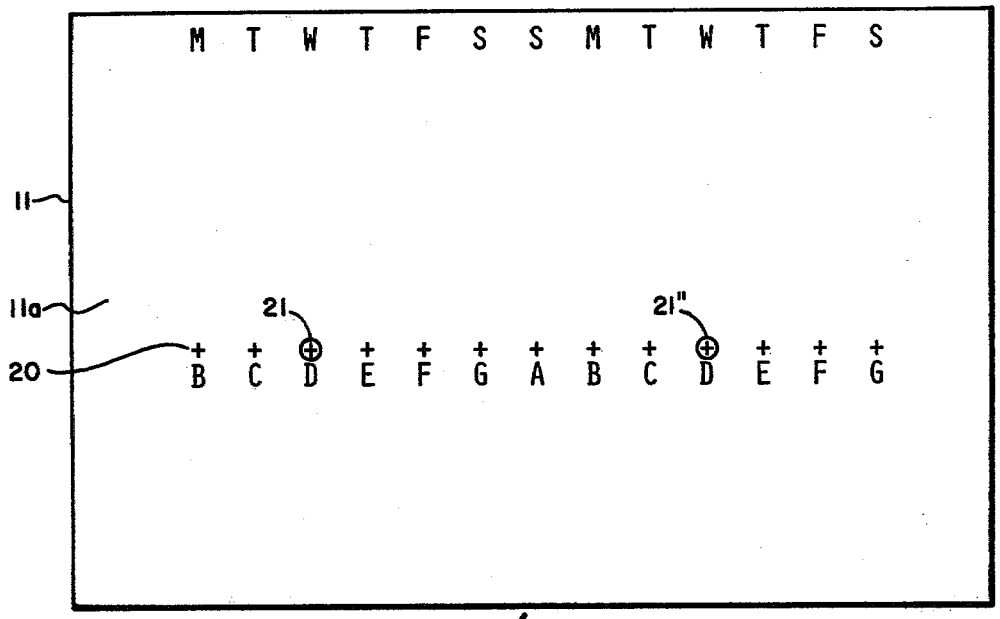
FIG. 2 is a diagrammatic representation of perpetual calendar design II according to a preferred embodiment of my subject invention.

Perpetual calendar design II is diagrammatically shown in FIG. 2. Calendar data comprising indications of the days of the week by name (abbreviations thereof), multiply listed in thirteen columns, and multiply listed indexing means comprising thirteen index positions and two movable index elements 21 and 21'', seven index positions apart, are put on one of first and second means such as on the panel II and calendar data comprising indications of the days of the month by number, singly listed in seven columns, and calendar data 14 comprising indications of the month of the year and including that of January of a new year, singly listed in seven columns, are put on the other of first and second means, such as on the movable panel 12.

By way of background, preferred calendar designs herein disclosed are built around an indexing system in which a single index moves cyclically over a set of seven index positions. A singly listed indexing means comprise a single movable index element and seven index positions over which the index element moves.

Indexing means put on the same means with the multiply listed one of the first two calendar data of 13 columns will be listed in 13 columns. Since a single index element can cover only seven positions, indexing means of 13 positions will require two index elements, such as 21 and 21'', which are put in positions seven positions apart. The two index elements at their respective positions represent duplicate index positions for the year. When their positions are to be changed for a new year, the two index elements are moved in unison (in parallel) to retain their seven-position-apart relationship. The only times when the particular calendar has a single index position will be when the index position for the year is the middle (7th) position.

In the embodiment of FIG. 2, and in other cases where the index positions are located behind the panel 12 in the assembled device, a slot 20' may be cut into the panel 12 in order to accommodate the index element(s) 21 (and 21''). Alternatively, the element(s) 21 (and 21'') may be inserted through holes 20 from behind the panel 11, or thin index elements may be employed between the panels, or the index positions 20 and indications 14 may be located at the tops of panels 11 and 12, respectively.

In setting the calendar for a month, the month column in the singly listed third calendar data comprising indications of the months of the year is aligned with the one of the two index elements 21 or 21'' which yields a complete monthly calendar.

Perpetual calendar design IV is diagrammatically illustrated in FIG. 4. Calendar data comprising indications of the days of the month by number, multiply listed in thirteen columns, and multiply listed indexing means 20 comprising thirteen index positions and two movable index elements (see FIG. 2, 21 and 21'') seven index positions apart, are put on one of first and second means, and singly listed calendar data comprising indications of the days of the week by name (abbreviations thereof) and calendar data 14 comprising indications of the months of the year and including that of January of a new year (NEW) are put on the other of first and second means.

Perpetual calendar design V is diagrammatically illustrated in FIG. 5. Calendar data comprising indications of the days of the week by name (abbreviations thereof), multiply listed in nineteen columns, and singly listed calendar data 14 comprising indications of the months of the year and including that of January of a new year are put on one of first and second means, and calendar data comprising indications of the days of the month by number, singly listed in seven columns, and singly listed indexing means comprising seven index positions 20 and a movable index element (see FIG. 3, 21) locatable at any one of these positions are put on the other of first and second means.

Perpetual calendar design VI is diagrammatically illustrated in FIG. 6. Calendar data comprising indications of the days of the week by name (abbreviations thereof), multiply listed in nineteen columns, and singly listed indexing means comprising seven index positions 20 and a movable index element (see FIG. 3, 21) locatable at any one of these positions are put on one of first and second means, and calendar data comprising indications of the days of the month by number, singly listed in seven columns, and singly listed calendar data 14 comprising indications of the months of the year, including that of January of a new year (NEW), are put on the other of first and second means.

Perpetual calendar design VII is diagrammatically shown in FIG. 7. Calendar data comprising indications of the days of the month by number, multiply listed in nineteen columns, and calendar data 14 comprising indications of the months of the year and including that of January of a new year (NEW), singly listed in seven columns, are put on one of first and second means, and singly listed calendar data comprising indications of the days of the week by name (abbreviations thereof) and singly listed indexing means comprising seven index positions 20 and a movable index element (see FIG. 3, 21) locatable at any one of these positions are put on the other of first and second means.

As seen in FIG. 7, the third calendar data 14 are listed in columns in registry with the middle seven columns, between the seventh and thirteenth columns, inclusive, of the multiply listed calendar data comprising indications of the days of the month by number. The January and October column is in registry with the number 1-column of the indications of the days by number.

Perpetual calendar design VIII is diagrammatically illustrated in FIG. 8. Calendar data comprising indications of the days of the month by number, multiply listed in nineteen columns, and singly listed indexing means comprising a scale of seven index positions 20 and a movable index element (see FIG. 3, 21) locatable at any one of these positions are put on one of first and second means, and singly listed calendar data comprising indications of the days of the week by name and singly listed calendar data 14 comprising indications of the months of the year including an indication of January of a new year (NEW) are put on the other of the first and second means, As seen n FIG. 8, the third calendar data 14 are listed on the panel 12 in columns in registry with the columns of the singly listed calendar data comprising indications of the days of the week by name (or abbreviation). The seven positions of the indexing means or holes 20, on the other hand, are in registry on the panel 11 with the middle seven columns, between the seventh and thirteenth columns, inclusive, of the multiply listed calendar data comprising indications of the days of the month by number multiply listed in nineteen columns.

In FIGS. 5 and 8 a second set of JAN-JAN', and in FIGS. 6 and 7 a second NEW, have been inserted among the third calendar data 14 as an aid to the adjustment of the index (element) at the extremes of the basic seven index positions 20. These additional indications are optional, since the index element can always be adjusted as mentioned above by shifting the index one position for a common year, or two positions for a leap year.

It is not always necessary that a calendar design be operable perpetually. It may be desirable in certain cases to have calendar designs which are good for a short period of little more than one year, for a five-to-six year period, or for a ten-to-twelve year period, for instance.

Perpetual calendar designs I–VIII are converted to multi-year calendar designs with simple changes in the indexing means. The movable index element is eliminated, the indication of January in a new year is omitted in the third calendar data, and the index positions are labeled with calendar data comprising indications of the years by number.

The location of the indication of any particular year included in the calendar data comprising indications of the years by number represents the index position for the year. The indication of the following year in an adjacent position or next to an adjacent positions represents the adjustment of the index position for that new year. The calendar data comprising indications of the years by number thus carry out the dual functions of (a) serving as the movable index and (b) making the adjustment in index position for each new year.

While the multi-year calendars are not as long-lived as the perpetual calendars, they do have the advantage of simplicity of construction and operation.

It is simpler to imprint the indications of the years than to construct a movable index element. The adjustment of the index position for each new year is automatically taken care of by the imprinted indications of the years.

The indications of the years by number which label a scale or single row of seven index positions will be referred to as a cycle. By way of example, a cycle of the indications of the years by number will cover a period of 5–6 years.

Multi-year calendar designs diagrammatically illustrated in FIGS. 10–15 are derived from perpetual calendar Designs I, III, V-VIII, respectively, with the letter M being associated with the particular design. Some of the designs are illustrated with a single cycle of the indications of the years by number, others with two cycles. However, the number of cycles of the indications of the years is optional in any of the multi-year calendar designs.

In the example of Design III-M, FIG. 11, the calendar device is good for a period of 5 to 6 years. After this period, it is not necessary that the entire calendar device be replaced. A replacement means bearing singly listed calendar data comprising indications of the days of the week by name and calendar data comprising indications of the years for the next 5–6 year period can be provided to extend the useful life of the calendar device.

Or, the life of the calendar device can be initially extended by having additional cycles of the indications of the years, as was done in a few of the design examples, e.g. FIG. 14, Design VII-M. However, since each year requires an indication, increasing the longevity of the calendar beyond a certain limit causes an undesirable piling up of numbers at each position.

In TABLE XI, calendar data comprising indications of the years for the first, second, third, and fourth cycles starting with the indication for 1978 are shown. The actual arrangement of the indications of the years in each row of seven index positions depends upon the relationship of the columns of the third calendar data and the columns of the one of the first two calendar data with which the third calendar data are paired, and the year from which the indications of the years is started.

TABLE XI.

| | Calendar Data Comprising Indications of the Year by Number for Four Cycles Starting with the Indication for 1978 | | | | | | |
|---|---|---|---|---|---|---|---|
| Position Number | 1 | 2 | 3 | 4 | 5 | 6 | 7 |
| Cycle Number | | | | | | | |
| 1 | '78 | '79 | — | '80 | '80 | '82 | '83 |
| 2 | — | '84 | '85 | '86 | '87 | — | '88 |
| 3 | '89 | '90 | '91 | — | '92 | '93 | '94 |
| 4 | '95 | — | '96 | '97 | '98 | '99 | — |

The set of seven index positions on a multi-year calendar may be labeled with a single row or cycle of the indications of the years by number. Since there are seven index positions involved, the calendar data is obviously singly listed. When a single row or cycle of the indications are used to label the set of seven index positions, such calendar data comprising indications of the years by number will be referred to simply as "singly listed".

When there are two or more rows or cycles of the indications of the years labeling the set of seven index positions, such calendar data will be referred to as "multi-cyclically listed". This is to be distinguished from "multiply listed" in which the additional columns and indications are duplicate columns and indications.

Calendar data comprising indications of the years by number have been previously used in the calendars on the Neuvex and Longines-Wittnauer wrist watches and the circular calendar of Anderson & Sons, Inc. However, there are differences between these prior art calendar data comprising indications of the years and the calendar data which I have just described.

In my calendar designs, the change in index position is cyclical over a small number (7) of index positions. In these prior art calendars the change in index position each year is in one direction over a large number (28, 35) of index positions.

The difference between the two sets of calendar data arises from the pairing in my designs of the indications of the years with one of the first two calendar data having left and right margins and the pairing in the case of the prior art calendars of the indications of the years on the same means with the indications of the days of the week in an endless configuration.

Only the multiply listed—not the singly listed—ones of the first two calendar data can be put into an endless configuration when seven columns of the calendar data have to be displayed at one time. Further, the calendar data comprising indications of the years of the type used in wrist watch calendars and the circular calendar of Anderson & Sons, Inc. have been limited to pairing on the same means with the indications of the days of the week in an endless configuration. Calendar data comprising indications of the days of the month by number cannot be put easily into an endless configuration.

By contrast, calendar data comrising indications of the years by number which label a set of seven index positions usable cyclically can be paired on the same means with singly listed or multiply listed calendar data comprising indications of the days of the week by name or the days of the month by number, leading to a wide variety of calendar designs.

I have standardized on thirteen (13) and nineteen (19) columns for the multiply listed one of the first two calendar data.

However, it is possible to have any intermediate number of columns between thirteen (13) and nineteen (19) for the multiply listed ones of the first two calendar data. The number of positions in the corresponding indexing means, paired on the same means, decreases progressively from thirteen to seven as the number of columns in the multiply listed one of the first two calendar data increases from thirteen to nineteen.

The multiply listed ones of the first two calendar data in an endless configuration will have a number of columns which is a multiple of seven—14, 21, 28, 35, etc.

We can compare the two types of indications of the years by number which are obtained by pairing with multiply listed one of the first two calendar data of fourteen columns in (a) an endless configuration and (b) with right and left margins.

TABLE XII.

Calendar Data Comprising Indications of the Years by Number Paired with Multiply Listed Calendar Data Comprising Indications of the Days of the Week by Name of Fourteen (14) Columns (a) in an Endless Configuration and (b) with Right and Left Margins.

| | | | | | | | | | | | | | | |
|---|---|---|---|---|---|---|---|---|---|---|---|---|---|---|
| a. | F | S | S | M | T | W | T | F | S | S | M | T | W | T |
| | '76 | '77 | '78 | '79 | — | '80 | '81 | '82 | '83 | — | '84 | '85 | '86 | '87 |
| b. | F | S | S | M | T | W | T | F | S | S | M | T | W | T |
| | | '77 | '78 | '79 | — | '80 | '81 | '76 | '77 | '78 | '79 | — | '80 | |

The period of years covered in (b) does not increase beyond that covered by a single set of seven index positions (singly listed and labeled with a single cycle of the indications of the years) because the additional positions above seven are simply duplicate positions. On the other hand, in the endless configuration in (a), additional positions increase the period of years covered by the calendar. Clearly the two types of the indications of the years are different, reflecting two different patterns of change in index positions, in turn, resulting from two different configurations of the calendar data sets—one in an endless configuration, the other with left and right margins—with which the indications of the years are paired.

FIGS. 10 to 15 show diagrammatically six multi-year calendar designs derived from the above perpetual calendar designs by substituting the indexing means of the perpetual calendar designs with calendar data comprising indications of the years by number and the non-inclusion or omission of the indication for January of a new year in the calendar data comprising indications of the months of the year. Eight multi-year calendars are derivable from eight perpetual calendar designs. However, I have omitted two multi-year calendar designs which, although operable, have indications of the years in duplicates. These are the designs derived from perpetual calendar designs II and IV.

The multi-year calendar design I-M is diagrammatically illustrated in FIG. 10. Again, the structure shown in FIGS. 3*a–c* may be employed, if desired, for mounting panels 11 and 12. Calendar data comprising indications of the days of the week by name (abbreviations thereof), multiply listed in thirteen columns, and calendar data 14 comprising indications of the months of the year, multiply listed in thirteen columns, are put on one of first and second means, and calendar data comprising indications of the days of the month by number, singly listed in seven columns, and singly listed calendar data comprising indications 27 of the years by number are put on the other of the first and second means.

The single cycle in the indications of the years by number is shown simply for illustrative purpose since the number of cycles is optional.

Multi-year calendar design III-M is diagrammatically illustrated in FIGS. 11*a* to *e*. Calendar data comprising indications of the days of the month by number, multiply listed in thirteen columns, and calendar data 14 comprising indications of the months of the year, multiply listed in thirteen columns, are put on one of first and second means and singly listed calendar data comprising indications of the days of the week by name (abbreviations thereof) and singly listed calendar data 27 comprising indications of the years by number are put on the other of the first and second means.

In multi-year calendar designs I-M, III-M, V-M, VI-M, VII-M, VIII-M, the only calendar data which go out of date with the passage of time are the indications of the years included in calendar data comprising indications of the years by number. Therefore, it is only the indications of the years which need to be replaced to keep the calendar operable.

In FIG. 11, it is shown that different movable panels 12 may be provided with different successions of year indications 27, 27*a*, 27*b*, 27*c*, etc., as more fully described below, such that one panel 12 may be replaced with another panel 12 periodically to extend the useful life of a calendar over a span of years.

it is also possible to renew only the indication of the years periodically, such as on one and the same panel 12. Alternatively, a first set of indications of the years 27 may be put on a first disposable means, such as on the display surface of a thin sheet or film body, e.c., paper, plastics, metal, metallized plastics, decal, etc., as shown by dotted lines 12' in FIG. 11*b*, and adhered to the associated one of the first and second means, that is, in the illustrated example on the movable panel 12 of FIG. 11*b*, such that the indications of the years 27 are in operative relationships with the third calendar data comprising indications of the months of the year 14.

Figure 11A:
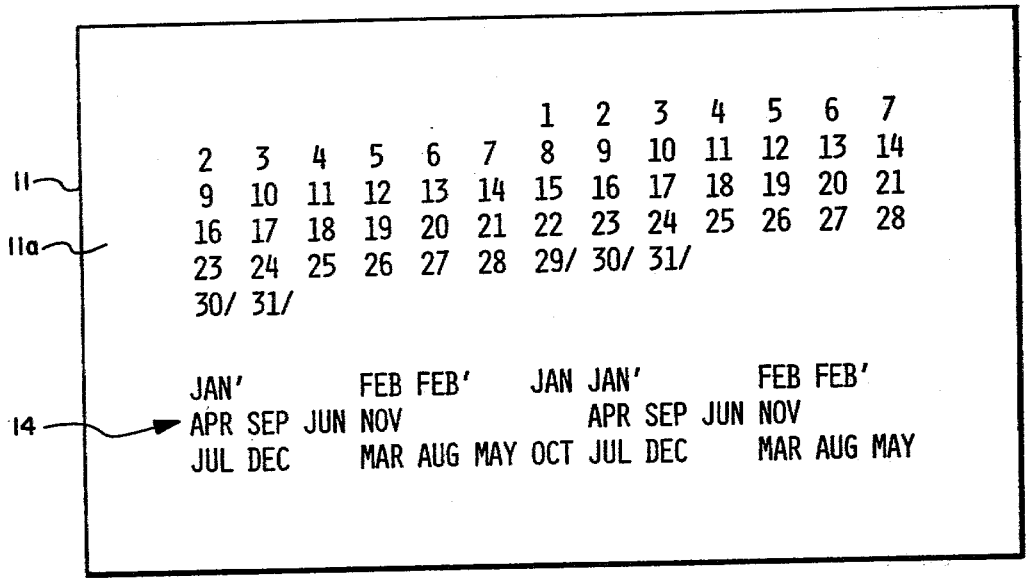
Figure 11B:
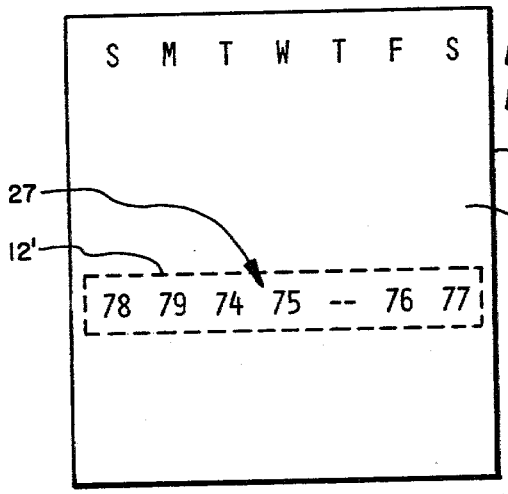
Figure 11C:
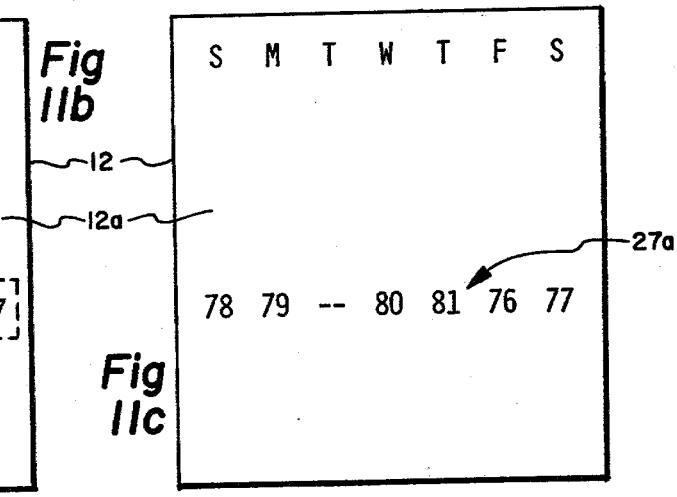
Figure 11D:
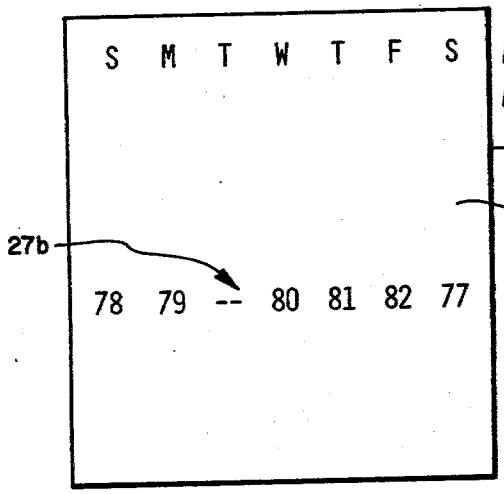
Figure 11E:
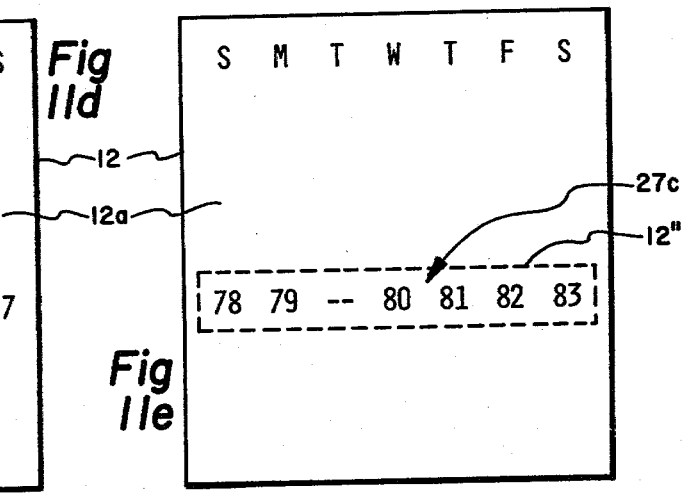

After expiration of the last year included in the indications of years, 12', or at any desired earlier time, a second disposable means 12'' shown in FIG. 11*e* but actually locatable on the panel 12 of FIG. 11*b*, and bearing a second set of indications of years 27*c*, is adhered to the associated one of first and second means, such as the panel 12, in lieu of first disposable means 12'. The second set 27*c* includes indications of the years later than one or more, or all, of the years included in the first set 27.

An alternative embodiment will presently be described.

Particularly, the calendar data 27 may be singly listed as seen at 27*a* to *c*. As seen in FIGS. 11*b* to *e*, several movable panels 12 may be provided, each having a different succession of year indications 27, 27*a*, 27*b* or 27*c*, may be provided for covering a span of several years. In practice, the movable panels 12 are periodically exchanged relative to the stationary panel 11, so as to cover the years in question. The exchangeable panels 27 to 27*c* may overlap as to annual coverage, or may be successive, as desired or practical.

The single cycle in the indications of the years by number is shown simply for illustrative purpose.

Multi-year calendar design V-M is diagrammatically illustrated in FIG. 12. Calendar data comprising indications of the days of the week by name (abbreviations thereof), multiply listed in nineteen columns, and calendar data 14 comprising indications of the months of the year, singly listed in seven columns, are put on one of first and second means, and calendar data comprising indications of the days of the month by number, singly listed in seven columns, and multicyclically listed calendar data 27 comprising indications of the years by number are put on the other of the first and second means.

The double cycles in the indications of the years by number is shown simply for illustrative purpose since the number of cycles may in practice be higher or lower.

With further reference to FIGS. 11*a* to *e*, the third calendar data 14 comprising indications of the month of the year are multiply listed in columns. The multiply listed calendar data comprising indications of the days of the month by number are arranged in columns in registry with the columns of the multiply listed third calendar data 14. The singly listed calendar data comprising indications of the days of the week by name are arranged in columns in registry with the columns of calendar data 27 to 27*c* of the singly listed indexing means.

Multi-year calendar design VI-M is diagrammatically illustrated in FIG. 13. Calendar data comprising indications of the days of the week by name (abbreviations thereof), multiply listed in nineteen columns, and singly listed calendar data 27 comprising indications of the years by number are put on one of first and second means, and calendar data comprising indications of the days of the month by number, singly listed in seven columns, and calendar data 14 comprising indications of the months of the year, singly listed in seven columns, are put on the other of first and second means.

The single cycle in the indications of the years by number is shown simply for illustrative purpose.

Multi-year calendar design VII-M is diagrammatically illustrated in FIG. 14. Calendar data comprising indications of the days of the month by number, multiply listed in nineteen columns, and calendar data 14 comprising indications of the months of the year, singly listed in seven columns, are put on one of first and second means, and singly listed calendar data comprising indications of the days of the week by name (abbreviations thereof) and multicyclically listed calendar data 27 comprising indications of the years by number are put on the other of the first and second means in seven columns each.

The calendar data 27 comprising indications of the year by number are multi-cyclically listed beyond the indications included in a single row of seven positions. These calendar data may, however, be singly listed by omitting either row.

The calendar data 27 are arranged in columns and the indications of the days of the week by name are arranged in columns in registry with the columns of the data 27. The singly listed third calendar data 14 are arranged in columns in registry with the middle seven columns, between the seventh and thirteenth columns, inclusive, of the multiply listed calendar data comprising indications of the days of the month by number, multiply listed in nineteen columns.

Multi-year calendar design VIII-M is diagrammatically illustrated in FIG. 15. Calendar data comprising indications of the days of the month by number, multiply listed in nineteen columns, and multicyclically listed calendar data 27 comprising indications of the years by number are put on one of first and second means, and singly listed calendar data comprising indications of the days of the week by name (abbreviations thereof) and calendar data 14 comprising indications of the months of the year, singly listed in seven columns, are put on the other of first and second means.

Doubly cycled indications of the years are used here for illustration of a multi-cyclical listing.

The third calendar data 14 are singly listed in columns. The singly listed calendar data comprising indications of the days of the week by name are arranged in columns in registry with the columns of the singly listed third calendar data 14. The data 27 comprising indications of the year by number included in the indexing means are arranged in columns in registry with the middle seven columns between the seventh and thirteenth columns, inclusive, of the multiply listed calendar data comprising indications of the days of the month by number, listed in nineteen columns.

In my discussions on calendar designs, I have shown how the various possible dispositions of the four data components can give rise to a family of perpetual and multi-year calendars. In the construction of actual calendar devices based on these designs, additional considerations come up, such as:

(1) which one of the two means bearing the first two calendar data separately is to be made movable relative to the other which is kept stationary;

(2) what to do with the unused or extraneous data from a month's calendar display;

(3) whether a movable means bearing the multiply listed one of the first two calendar data is to be rigid or flexible or endless;

(4) whether the first two calendar data and the calendar setting components are to be kept apart or placed together such that the columns of the paired components are in registry on the respective means;

(5) whether a smaller means bearing singly listed other of the first two calendar data should be moved in front or behind a larger means bearing multiply listed one of the first two calendar data.

Such considerations apply to each of the various calendar designs, making it possible to have several different constructions and, therefore, different calendar devices for each calendar design.

A desideratum in calendar construction is to have as large a monthly calendar display as possible relative to the overall size of the calendar device, or stated conversely, to have a minimum frontal size of the calendar device for a given size of monthly calendar display.

I have found that when the two means bearing the first two calendar data are flat, the overall frontal size of the calendar device is kept smaller by (a) keeping the means bearing the multiply listed one of the first two calendar data stationary and making the means bearing the singly listed other of the first two calendar data movable and (b) keeping an "open" calendar by not covering up most of the data extraneous to the month's calendar display. This is contrary to the practice in the calendar constructions of the prior art using rigid panels, e.g., Leckey, U.S. Pat. No. 1,266,499; Lauer, U.S. Pat. No. 1,558,020; Zabriskie, U.S. Pat. No. 1,073,206, where the small size of the monthly calendar relative to the overall size of the calendar devices is apparent.

We can make a comparison of the sizes by comparing approximate widths expressed in terms of the number of columns of calendar data. If we take the width of a monthly calendar display as being seven (7) columns and the width of the means bearing multiply listed calendar data as being thirteen (13) columns, the width of the calendar device will be approximately thirteen (13) columns if the means bearing the multiply listed calendar data is kept stationary. If this same means is made movable, the width of the calendar device will have to be increased to nineteen (19) columns to include the movable means from its extreme left to its extreme right position.

If it is decided to keep the calendar "open" by not covering up extraneous data and if the means bearing the multiply listed one of the first two calendar data is to be made movable in calendar setting, the size of the calendar device will be thirteen (13) columns wide but the operation of the device will require space equivalent to nineteen (19) columns.

Covering all extraneous data on a flat panel has the effect of increasing the frontal size of the calendar device since the means being the singly listed other of the first two calendar data which has to prove the cover will have to be nineteen (19) columns wide.

Repeating, the overall frontal size of a calendar device is kept smaller, or the size of the monthly calendar display is made larger relative to the overall frontal size of the calendar device by keeping an open calendar and keeping the flat means bearing the multiply listed one of the first two calendar data stationary.

The overall size of a calendar device can be reduced to a minimum by use of a movable means comprising a flexible medium and bearing the multiply listed one of the first two calendar data. The flexible medium can be put into one of two configurations. In one, the ends of the flexible medium are joined together to form a closed loop, endless configuration. The extraneous data will be on the opposite side of the loop from the displayed portion. In the second, the ends of the movable, flexible medium are attached to rollers, one on each end. The portions of the flexible medium bearing the extraneous data are wound up on the rollers which are placed on the right and left sides of the displayed portion. In both configurations, the flexible medium is moved in either direction in calendar setting if the number of columns in the multiply listed one of the first two calendar data and that in the multiply listed one of the calendar setting components on the same means are not an exact multiple of seven.

These constructions involving the use of a movable, flexible medium are particularly suitable for Designs V-VIII, where the multiply listed one of the first two calendar data carry nineteen (19) columns, and are illustrated in the preferred embodiments of the invention.

In perpetual calendar designs, the adjustment of the index position each year requires the movement of only a single element. Simple constructions are therefore possible for the indexing means of which the following examples are simply illustrative and are, therefore, not limited to these examples.

The seven index positions can be represented by seven holes on the appropriate one of the first and second means. A marker peg such as a knurled head screw inserted in any one of these holes represents the index position for the year.

The index positions and the movable index element may be represented by two different materials which are attractable or attachable to each other. Examples of such pairs are magnet and magnetically attractable material, hook and loop fasteners (Velcro, Sotchmate), and adhesive systems.

The concept of making a smaller means bearing singly listed one of the first two calendar data movable relative to a stationary, flat means bearing multiply listed other of the first two calendar data while leaving most of the unused or extraneous data elements uncovered is novel and has utility beyond the types of perpetual and multi-year calendar designs herein disclosed.

This results in a smaller size of calendar devices relative to the size of the monthly calendar displays, as explained before, but also in devices in which the position of the monthly calendar display changes each month except for March in a common year.

Means bearing one or the other of the first two calendar data do not necessarily have to be rigid themselves for this application. Such means may comprise flexible medium, e.g. sheets of paper, plastics, woven fabric, if they can be maintained and used in a flat configuration, such as by hanging.

Perpetual calendar device 30 shown in FIGS. 16 and 17 is based on perpetual calendar Design III, the same as the calendar device 10 of FIGS. *3a–c*. Accordingly, the corresponding parts are labeled or referenced in the same way. The difference is in the means by which transparent panel 12 is movably supported in front of panel 11. Panel 12 in calendar device 30 slides between two strips 31 and 32 which are mounted horizontally along the top and bottom parts of the display surface of panel 11 and in which grooves 33 and 34 are provided to keep panel 12 on track.

Referring to FIGS. 18 and 19, the drawings show the front and side views, respectively, of multi-year calendar device 40 according to a preferred embodiment of the subject invention.

Panel 41, defining a first display surface, bears imprinted multiply listed calendar data comprising indications 42 of the days of the month by number and imprinted multiply listed calendar data comprising indications 43 of the months of the year. The indications 43 of the months of the year are in a left-reading sequence. A transparent panel 44, defining a second display surface and movably supported in front of panel 41, bears imprinted singly listed calendar data comprising indications 45 of the days of the week by name (abbreviations thereof), imprinted rectangular (or square) linear frame 46 for outlining part of the first display surface which includes the seven successive columns of the indications 42' of the days of the month by number representing a month's calendar display, view-obstructing or view-blocking columns 47 and 48, one on each side of frame 46, for obscuring from an observer's view the columns of the indications of the days of the month by number immediately adjacent to the seven successive columns pertinent to the month's calendar display, and calendar data comprising indications 49 of the years by number which serve as the indexing means in the calendar device. The columns of the indications 43 of the months of the year are in registry with the columns of the indications 42 of the days of the month by number and the columns of the indications 49 of the years by number are in registry with the columns of the indications 45 of the days of the week by name.

Panel 44 is movably supported in front of panel 41 by means of two strips 50 and 51 mounted horizontally along the top and bottom parts, respectively, of the display surface of panel 41 and in which grooves 52 and 53 are provided to keep the movement of panel 44 relative to panel 41 on track. The calendar for any month of the year is set by aligning the indication of the year included in calendar data comprising indications 49 of the years by number with the indication of the month included in the indications 43 of the months of the year. The indication of a year serves as an index element at the proper index position for the year. The January-October column in the indications 43 of the months of the year is in registry with the 1-column in the indications 42 of the days of the month by number. By way of example, calendar device 40 covers the period 1976–1981. A small knob 54, permanently attached to panel 44, serves as a handle for moving panel 44. Calendar device 40 is based on multi-year calendar design III-M.

Referring to FIGS. 20 to 22, the drawings show a perpetual calender device 50 in front (FIG. 20), side (FIG. 21), and top (FIG. 22) views according to a preferred embodiment of the subject invention. A box enclosure 51 is constructed of rigid materials, e.g., wood, plastics, metal, and the like, one side of which, defining a first display surface, bears imprinted singly listed calendar data comprising indications 52 of the days of the week by name (abbreviations thereof) above a cutout window 53 for framing the monthly window displays, and indexing means 54 below the cutout window 53.

The indexing means 54 comprise a set of seven index holes 55, representing a scale of seven index positions, and a movable index knob screw 56, representing a movable index element locatable at any one of the seven index holes (positions). The index holes 55 are in registry with the columns of the indications 52 of the days of the week by name. A movable, flexible medium 57, e.g. fabric, plastic sheet, elastomer sheet, paper, etc., defining a second display surface, is supported inside the box enclosure 51, behind the cutout window 53, in an endless (closed loop) configuration on two rollers 58 and 59, one on each side of the cutout window 53. The flexible medium 57 bears imprinted multiply listed calendar data comprising indications 60 of the days of the month by number in nineteen columns and imprinted calendar data comprising indications 61 of the months of the year, singly listed in seven columns and in a left-reading sequence. The columns of the indications 61 of the months of the year are in registry with the middle seven columns of the indications 60 of the days of the month by number. Because of its endless, closed loop configuration, only a part of the movable, flexible medium 57 will be visible through the cutout window 53 at any one time. The alignment of the index knob screw 56, at its proper position for the year at one of the seven index holes 55 for the year, with the indication of a month in the calendar data comprising indications 61 of the month of the year results in the month's calendar display.

Such an alignment is made by turning one of the knobs 62 and 63 which are attached to shafts 64 and 65, respectively, and which are, in turn, attached to rollers 58 and 59, respectively, through their central axes. The spacing between rollers 58 and 59 is such that the flexible medium 57 in its closed loop configuration has sufficient tension to be moved by the turning of either of the rollers 58 and 59. The flexible medium 57 can be moved in either left or right direction. Calendar device 50 is based on perpetual calendar design VII.

The multi-year calendar device 70 shown in FIGS. 23 to 25 is basically of the same construction as the perpetual calendar device 50 shown in FIGS. 20 to 22. FIGS. 23, 24 and 25 are the front, side, and top views, respectively, of a calendar device 70, which is based on calendar design VII-M. Imprinted calendar data comprisng indications 71 of the years by number in calendar device 70 replace the indexing means 54 of the calendar device 50 of FIGS. 20 to 22 and the indication of January of a new year which is found in calendar data comprising indications 61 of the months of the year in calendar device 50 is not included in the analogous calendar data for calendar device 70. Except for these differences, the calendar devices 50 and 70 are similar and the corresponding parts of the two calendar devices are labeled or referenced in the same way.

The calendar for any month of a year included in imprinted indications 71 of the months of the year is set by aligning the indication of the month in the indications 61 of the months of the year with the indication of the year in the indications 71 of the years by number. By way of example, the calendar device in FIGS. 23 to 25 covers the period 1978–1983.

Referring to FIGS. 26 to 28, the drawings show a multi-year calendar device 75 in front (FIG. 26), side (FIG. 27), and top (FIG. 28) views in accordance with still another preferred embodiment of the subject invention. A box enclosure 76 constructed with rigid materials, e.g., wood, plastics, metal, etc., one side of which defines a first display surface and bears imprinted singly listed calendar data comprising indications 77 of the days of the week by name (abbreviations thereof) above a cutout window 78 for framing the monthly window displays, and imprinted calendar data comprising indications 79 of the months of the year, singly listed in seven columns and in a right-reading sequence, below the cutout window 78. The columns of the indications 79 of the months of the year are in registry with the columns of the indications 77 of the days of the week by name. A movable, flexible medium 80, e.g., of fabric, plastic sheet, elastomer sheet, paper, etc., defining a second display surface, is supported inside the box enclosure 76, behind the cutout window 78, between two rollers 81 and 82, one on each side of the cutout window 78.

One of the two ends of the flexible medium 80 is attached to roller 81 and the other, to roller 82. The flexible medium 80 bears imprinted multiply listed calendar data comprising indications 83 of the days of the month by number and imprinted calendar data comprising indications 84 of the years by number, singly listed in seven columns. The indications 83 of the days of the month by number are multiply listed in nineteen columns and the columns of the singly listed indications 84 of the years by number are in registry with the middle seven columns of the indications 83 of the days of the month by number. Only a part of the movable, flexible medium 80 is visible through the cutout window 78, most of the rest being wound on the two rollers 81 and 82. The visible part of the flexible medium 80 carries the seven successive columns of the indications 83 of the days of the month by number which make up the month's calendar. The calendar for any month of a year is set by aligning the indication for the year included in the indications 84 of the years by number with the indication of the month included in the indications 79 of the months of the year. To make this alignment, the flexible medium 80 is moved by turning one of the knobs 81' and 82' which are attached to shafts 85 and 86, respectively, which are, in turn, attached to rollers 81 and 82, respectively, through their central axes.

A connecting belt 87 around both shafts 85 and 86 makes it possible to turn rollers 81 and 82 in unison and to move the flexible medium 80 in either right or left direction by turning either one of the two knobs 81' and 82'. By way of example, the calendar device 75 shown in FIGS. 26 to 28 covers the period 1978–1983.

Referring to FIGS. 29 to 31, the drawings show a multi-year calendar device 90 in still another preferred embodiment of the subject inventon. FIGS. 29, 30 and 31 represent the front, side, and top views, respectively, of the calendar device 90. This device is basically the same as the calendar device 40 described in FIGS. 18–19, being based on the same calendar design III-M and differs from calendar device 40 only constructionwise. Panel 91, defining a first display surface, bears multiply listed calendar data comprising indications 92 of the days of the month by number in thirteen columns and multiply listed calendar data comprising indications 93 of the months of the year in thirteen columns. A movable transparent panel 94, defining a second display surface, bears singly listed calendar data comprising indications 95 of the days of the week by name, singly listed, singly cycled calendar data comprising indications 96 of the years by number, and a rectangular (or square) linear frame 97 which serves to outline part of the first display surface including the seven successive columns of the indications 92' of the days of the month by number representing a month's calendar display.

Alternatively, movable panel 94 may be opaque or semi-transparent with frame 97 delineating a cutout opening for displaying a month's calendar.

The columns of the indications 96 of the years by number are in registry with the columns of the singly listed indications 95 of the days of the week by name and the columns of the indications 93 of the months of the year, in a left-reading sequence, are in registry with the columns of the multiply listed indications 92 of the days of the month by number on their respective panels. Additionally, the January-October column is in registry with the 1-column on panel 91. Panel 94 is movably supported in front of panel 91 by attachment to a strip 98 which has a long horizontal opening and is attached to panel 91 through spacers 99 and 100. Panel 94 is attached to strip 98 by means of two screws 101 and 102. The screws 101 and 102 are of the type with two telescoping stems (male and female) with opposite heads, one on each stem, which are commercially available. The opposite heads hold panel 94 and strip 98 together while still making it possible for panel 94 to be movable with the stems of the screws 101 and 102 riding on the lower edge of the opening in strip 98. A knob 103 attached to panel 94 through the opening in strip 98 is a convenient handle for manually moving panel 94. The calendar for any month of the year is set by aligning the indication of the year included in the indications 96 with the indication of the month included in the indications 95 of the months of the year. By way of example, the calendar device in FIGS. 29–31 covers the period 1976–1981.

By way of general background, there are two patterns in which an index can be made to follow in its change in position from year to year.

(a) The index can be made to move cyclically over seven index positions;

(b) The index can be made to move steadily over a line (row) of index positions numbering more than seven; without the index returning to any previous position.

The locations on the first two means or panels, the structures (number of columns), and the configurations (endless or with left and right margins) of the first two calendar data and the third calendar data fix or determine the index position for the year and the index positions for successive years.

The cyclically usable seven index positions in the preferred embodiments arise from the cyclically used seven columns of the first two calendar data and the third calendar data. Thus, the set of seven index positions is a fundamental quantity.

The index moves over the seven index positions in a very systematic manner in changing its position each new year. It moves over one position when the change is for a common year, two positions (skipping one) when the change is for a leap year.

In multi-year calendars, the index position for the year is labeled or listed with the indication of the year. Each fifth position (leap years come every four years) is skipped so that in each cycle of seven positions, one or two positions will be skipped if the multi-year calendar runs for seven years or less. Thus, in multi-year calendars the number of index positions and the number of years on the calendar will not coincide.

The discrepancy is even more when the life or run of the multi-year calendar is for 5 years, 4 years, 3 years, or even 2 years, where a complete cycle of seven positions is not required.

The cyclically usuable seven index positions exist whether they are all labeled or not since they are arrived at by geometrical considerations. That is, I consider a skipped position to be an index position. Over the years each of the seven positions will get its chance of being skipped.

In perpetual calenders, which run longer than multi-year calendars, skipped index positions do not matter much since within two cycles each of the seven positions will have served as the index position for the year.

Pattern (a), mentioned above, is followed when the index is put (paired) on the same means or panel with one of the first two calendar data with right and left margins. Pattern (b) is followed when the index is put on the same means or panel, with a multiply listed one of the first two calendar data in an endless configuration.

All of my preferred designs, perpetual and multi-year calendar, follow pattern (a) and will have a set of cyclically usable set of seven index positions. There are prior art calendars, e.g. the calendars on Wittnauer and Neuvex wrist watches, the calendar of Anderson & Sons, which do have calendar data comprising indications of the years by number but in which the index moves according to pattern (b). In multi-year calendars, the position of the indication of the year is the index position of the year.

In calendar designs I-VIII, discussed previously, the position of the index is adjusted for each year while the columns of the third calendar data comprising indications of the months of the year are kept fixed on their means or panel. (Selection iv-A).

It is also possible to make the adjustment in the relative positions of the calendar setting components by moving the columns of the third calendar data and keeping the index position fixed (Selection iv-B). For this second alternative, the columns of the third calendar data have to be made movable relative to the means or panel on which they are paired with one of the first two calendar data. To meet this requirement, the third calendar data are put on a third means, separate from but attached to and movable relative to the one of first and second means or panel with which they are associated. The third calendar data are multiply listed with at least thirteen columns but of these columns only seven successive columns—a complete single listing—are displayed at a time.

To accomplish this, the third means bearing the third calendar comprises a flexible medium arranged or configured such that the unused columns are rolled up on the sides of the displayed seven columns or are on the back of the third means arranged in an endless configuration.

The single index position, in operative relationship with the displayed seven columns of the third calendar data, is fixed for all the years on the other of first and second means or panels. The index position may be distinctly marked or labeled. Or it may be in registry with a data element or data elements of the first two calendar data, e.g., 1-column, Sunday column, or the other of first and second means, which can then be used to represent the index position. When this is done, the calendar design will appear to have only three data components.

Calendar design IX is diagrammatically shown in FIG. 32. Calendar data 13 comprising indications of the days of the month by number, multiply listed in thirteen columns, and the single index position 20 are put on one of first and second means, such as the display surface 11*a* of panel 11. Singly listed calendar data 15 comprising indications of the days of the week by name (abbreviation thereof), and indirectly, the third calendar data 14 comprising indications of the months of the year, including an indication of January of a new year ("NEW"), are put on the other of first and second means, such as the display surface 12*a* of panel 12. Third calendar data 14, in a right-reading sequence and multiply listed, are put on a third means or endless belt or loop configuration 19', attached to but movable relative to the other of first and second means. Seven columns of the third calendar data 14 are displayed at one time.

FIG. 32 shows a preferred arrangement for calendar design IX, showing the displayed seven columns of the third calendar data 14 in registry with the columns of the singly listed calendar data 15 comprising indications of the days of the week by name (abbreviations thereof). The single index position is in registry with the middle (seventh) column of the calendar data 13 comprising indications of the days of the month by number. The 1-column, which is arranged to be the middle column, may be used as the index without further marking.

A frame 16 to outline the columns of a month's calendar is carried on panel 12. For example, this can be a linear rectangular (or square) outline imprinted on a transparent panel or a rectangular (or square) cutout on an opaque panel.

In FIG. 32, panel 11 bearing the multiply listed calendar data 13 comprising indications of the days of the month by number is shown to be flat. In this form it is preferrable to make panel 12 bearing calendar data 15 comprising indications of the days of the week by name movable relative to a stationary panel 11.

It is also another preferred construction to put the multiply listed calendar data 13 on a flexible medium for panel 11 and to make it movable relative to a stationary panel 12 bearing calendar data 15 comprising indications of the days of the week by name. The portion of the flexible medium (now panel 11) bearing the unused data from calendar data 13 are rolled up on the sides of the displayed portion or are put in the back part of flexible medium arranged in an endless configuration (not shown).

Calendar devices based on calendar design IX have an advantage over those based on other calendar designs. The indications of all the months can be put in registry with the columns for the days of the week on which the months begin. This provides an automatic indication for the length of each month since the name of the following month appears in the column for the day after the end of a month.

Third calendar data comprising indications of the months of the year can be multiply listed in thirteen columns or in a multiple of seven, such as fourteen or twenty-one columns. When in a multiple of seven the third calendar data can be put in an endless configuration such that the first follows the fourteenth or twenty-first column and the data are put on a third means arranged in an endless configuration, such as a flexible belt in a closed loop.

When multiply listed in thirteen columns, the middle, unduplicated column includes the indications of the months of January and October. The indications of all the other months of the year, as well as the indications of January and February to be used only in leap years, and the indication of January of a new year, are in duplicate columns.

The following is a procedure for adjusting the positions of the columns of the third calendar data relative to the single fixed index position each year. At the beginning of the year, "NEW" in the third calendar data on one of the first and second means is aligned with the single fixed index on the other of first and second means to set the calendar for January of the new year.

Next, with the relative positions of the first two calendar data remaining fixed, the columns of the third calendar data are moved by moving the third means so that the column for "JAN" is aligned with the single fixed index if the new year is a common year, or the column for "JAN'" is aligned with the single index if, a leap year. The seven columns of the third calendar data which are now displayed in a single listing at a time are in proper order for setting the calendar of any month of the year by aligning the column for the indication of the month with the single index.

Of the duplicate columns including the indications of January for a leap year, the column adjacent to the column including the indications of January and October is the one to be aligned with single index for setting the order of the third calendar data for the new year in the case where the third calendar data are multiply listed in thirteen columns.

FIGS. 33*a* to *c* illustrate the procedure for adjusting the order of the columns in the third calendar data comprising indications of the months of the year for each new year. The same reference numerals are used to designate the same parts as in FIG. 32. Line XX is arbitrarily drawn to indicate that the single fixed index 20 is on panel 11 and that the third calendar data 14 comprising indications of the months of the year and including an indication of January of a new year ("NEW") on a movable third means or endless belt 19' are attached to panel 12.

FIG. 33*a* shows adjustment phase 1 as follows:

With the columns of the third calendar data 14 in correct order for the current year, "NEW" is aligned with the single fixed index 20 to set the calendar for January of the new year.

FIG. 33*b* shows adjustment phase 2 as follows:

While panels 11 and 12 are kept fixed, the columns of the third calendar data 14 on a movable means or belt 19' are moved so that "JAN" is in line with the single fixed index 20. If the new year is a common year, the columns of the third calendar data 14 are now in the right order for setting the calendars for the months of the year. However, if the new year is a leap year, the columns of the third calendar data 14 are moved until "JAN'" is in line with the single index 20, as shown in FIG. 33*c* for a modified second phase. The columns are now in proper order for the new, leap year.

The third calendar data comprising indications of the months of the year described in calendar designs I–VIII include an indication of January of a new year, which is an aid in determining the index position for each new year. However, there are alternative ways of determining the new index positions without involving the indication of January of a new year. Among these are:

a. A list of the index positions for a period of years is given in a table attached to the calendar to which the user refers to determine the index position for the year. This procedure is not too inconvenient since a new index position has to be determined only once a yaer. Calendar designs relying on this method are classified as multi-year calendars.

b. The changes in index position follow a simple, systematic pattern. The index shifts one position for a new year that is a common year, two positions for a leap year. The user follows this known change pattern to find the index position for each new year. Calendar designs relying on this method are classified as perpetual calendars.

Calendar designs can be adapted from calendar designs I–VIII by omitting the indication of January of a new year in the third calendar data of these designs. These derived designs are still novel because they still have other features which are part of preferred embodiments of this invention.

Calendar design X is diagrammatically shown in FIG. 34. It is basically the same as calendar design III except that its third calendar data do not include the indication of January of a new year. Calendar data 13 comprising indications of the days of the month by number, multiply listed in thirteen columns, and third calendar data 14 comprising indications of the months of the year, multiply listed in thirteen columns, are put on one of first and second means such as the display surface 11*a* of panel 11.

Singly listed calendar data 15 comprising indications of the days of the week by name (abbreviations thereof) and singly listed indexing means comprising seven index positions 20 and a movable index element 21, locatable at any one of these positions, are put on the other of first and second means, such as the display surface 12*a* of panel 12.

FIG. 34 also shows a preferred arrangement of the components in calendar design X. The index positions 20 are in registry with the columns of the indications of the days of the week by name (calendar data 15) and the columns of the indications of the months of the year (third calendar data 14) are in registry with the columns of the indications of the days of the month by number (calendar data 13). It is arranged for the 1-column and the January-October column to be the middle, unduplicated column in their respective multiply listed calendar data. The 1-column and the January–October column are put in registry on the one of first and second means, such as on the display surface 11*a* of panel 11.

In a preferred construction, panel 11 is kept stationary and panel 12, with frame 16 to outline the seven data columns in a month's calendar, is made movable relative to panel 11.

In use, the proper location of the index element 21 for the year at one of the seven index positions 20 may be determined from an attached table showing a list of years with the corresponding index positions. Or the user may determine the new index position for the new year from the index position for the current year by following the known change pattern.

The addition of the indication of January of a new year ("NEW") in the columns indicated in FIG. 34, converts the illustration from a diagrammatic drawing of calendar design X to a diagrammatic drawing of calendar design III. The use of the indication of January of a new year in determining the index position from each year has already been discussed.

The combination of indexing means comprising seven index positions and a movable index element with multiply listed third calendar data comprising indications of the months of the year provides a novel and unique means for achieving a change in the order of the seven columns of the third calendar data which are operative for the year. This is done by a shift in index position.

A column in the multiply listed third calendar data is operative if when aligned with the index a complete monthly calendar of seven date columns is displayed. A column is inoperative if the resultant calendar display is not complete, i.e., has less than seven date columns.

The third calendar data are in a cyclical sequence which is always the same. The order simply says which indications of the months are in the first column, which in the second column, etc., but always in the same sequence.

Each index position is in operative relationship with only seven successive columns of the thirteen-column calendar data comprising indications of the months of the year.

Thus, the first index position from the left is in operative relationship with the first seven columns from the left of the multiply listed third calendar data 14. With each shift in index position, the next column in the sequence, in the direction of shift, becomes operative with the new index position and a column on the other end becomes inoperative. Actually, since there are seven columns in a complete cycle, when a column becomes operative on one end, it is its duplicate column on the other end which becomes inoperative, i.e., it is the indications of the same months which become operative and inoperative. Each index position is in operative relationship with seven columns of the third calendar data in a particular order. With seven index positions, there are seven different orders of the third calendar data. Each shift in index position brings about a change in the order of the third calendar data.

These same changes are brought about when the columns of the third calendar data on a movable third means are moved relative to a single fixed index in calendar designs IX.

It is convenient for calendar setting purpose to have the seven columns of the third calendar data which are in operative relationship with the index position for the year isolated with a frame, such as an imprinted rectangular outline on a transparent panel. This panel can be moved as the index position changes to frame the seven operative columns of the third calendar data for each new index position.

The subject extensive disclosure will suggest or render apparent various modifications and variations within the spirit and scope of the invention to those skilled in the art.

I claim:

1. A perpetual calendar comprising in combination:

first means bearing first calendar data;

second means movable relative to said first means and bearing second calendar data;

one of said first and second calendar data comprising indications of the days of the week by name, and the other of said first and second calendar data comprising indications of the days of the month by number;

one of said first and second calendar data being multiply listed, and the other of first and second calendar data being singly listed;

means for controlling adjustments of said second means relative to said first means in accordance with different occurring calendar interrelationships of said first and second calendar data each month, comprising third calendar data including indications of the months of the year associated with one of said first and second means and corresponding indexing means associated with the other of said first and second means; and means for extending the usability of the calendar to an indefinitely long time, comprising means for making an adjustment each year of said indexing means relative to said third calendar data and to said other of said first and second means with which said indexing means are associated, including in said indexing means an index element movable relative to said other of said first and second means, said indexing means and said indexing element comprising a removable marker which further aids in said relative moving of said first and second means, including in said third calendar data an indication representing January of any year located in terms of an indexing position associated with the year preceding the particular year, and being separate and distinct from an indication of January of said preceding year.

2. A perpetual calendar as claimed in claim 1, wherein:

the calendar data comprising indications of the days of the week by name and the indexing means are associated with one of the first and second means, and the calendar data comprising indications of the days of the month by number and the third calendar data including indications of the months of the year and including said indications of January are associated with the other of the first and second means.

3. A perpetual calendar as claimed in claim 2, wherein:

said calendar data comprising indications of the days of the week by name and said indexing means are each multiply listed; and said calendar data comprising indications of the days of the month by number and said third calendar data including indications of the months of the year are each singly listed.

4. A perpetual calendar as claimed in claim 2, wherein:

said calendar data comprising indications of the days of the week by name are multiply listed in nineteen columns; and said indexing means, said third calendar data including indications of the months of the year and including said indications of January, and said calendar data comprising indications of the days of the month by number are each singly listed.

5. A perpetual calendar as claimed in claim 2, wherein:

said calendar data comprising indications of the days of the month by number and said third calendar data including indications of the months of the year and including said indications of January are each multiply listed; and said calendar data comprising indications of the days of the week by name and said indexing means are each singly listed.

6. A perpetual calendar as claimed in claim 2, wherein:

said calendar data comprising indications of the days of the month by number and said third calendar data including indications of the months of the year and including said indications of January each are multiply listed in thirteen columns; and said calendar data comprising indications of the days of the week by name and said indexing means are singly listed in seven columns and seven positions, respectively.

7. A perpetual calendar as claimed in claim 6, wherein:

the columns of said multiply listed third calendar data including indications of the months of the year and including said indications of January are in registry with the columns of said multiply listed calendar data comprising indications of the days of the month by number; and the positions of said indexing means are in registry with the columns of said singly listed calendar data comprising indications of the days of the week by name.

8. A perpetual calendar as claimed in claim 7, wherein:

said multiply listed third calendar data including indications of the months of the year include a column for the indications of January and October in registry with a column including day 1 included in said multiply listed calendar data comprising indications of the days of the month by number.

9. A calendar as claimed in claim 8, wherein:

said calendar data comprising indications of the days of the week by name and said indexing means are associated with said second means; and said calendar data comprising indications of the days of the month by number and said third calendar data including indications of the months of the year and including said indications of January are associated with said first means.

10. A calendar as claimed in claim 9, wherein:

said indexing means comprise seven index holes and a movable marker peg locatable at any one of said holes.

11. A perpetual calendar as claimed in claim 2, wherein:

said calendar data comprising indications of the days of the month by number are multiply listed in nineteen columns; and said third calendar data including indications of the months of the year and including said indications of January, said calendar data comprising indications of the days of the week by name, and said indexing means are each singly listed in seven columns and seven positions, respectively.

12. A perpetual calendar as claimed in claim 11, wherein:

said columns of said singly listed calendar data comprising indications of the days of the week by name are in registry with said positions of said singly listed indexing means; and said columns of said third calendar data including indications of the months of the year and including said indications of January are in registry with the middle seven columns, between the seventh and thirteenth columns, inclusive, of said nineteen columns of said multiply listed calendar data comprising indications of the days of the month by number.

13. A perpetual calendar as claimed in claim 12, wherein:

said singly listed third calendar data including indications of the months of the year include a column for the indications of January and October in registry with a column including day 1 included in said multiply listed calendar data comprising indications of the days of the month by number.

14. A perpetual calendar as claimed in claim 13, wherein:

said other of said first and second means comprises a movable, flexible medium.

15. A calendar as claimed in claim 13, wherein:

said multiply listed calendar data comprising indications of the days of the month by number and said singly listed third calendar data including indications of the months of the year and including said indications of January are associated with said second means; and said singly listed calendar data comprising indications of the days of the week by name and said indexing means are associated with said first means.

16. A calendar as claimed in claim 15, wherein:

said second means comprise a movable, flexible medium.

17. A perpetual calendar as claimed in claim 1, wherein:

said calendar data comprising indications of the days of the week by name and said third calendar data indications of the months of the year and including said indications of January are associated with one of the first and second means; and said calendar data comprising days of the month by number and said indexing means are associated with the other of the first and second means.

18. A perpetual calendar as claimed in claim 17, wherein:

said calendar data comprising indications of the days of the week by name and said third calendar data comprising indications of the months of the year and including said indications of January are each multiply listed; and said calendar data comprising indications of the days of the month by number and said indexing means are each singly listed.

19. A perpetual calendar as claimed in claim 17, wherein:

said calendar data comprising indications of the days of the week by name are multiply listed in nineteen columns; and said third calendar data indications of the months of the year and including said indications of January, said calendar data comprising indications of the days of the month by number, and said indexing means are each singly listed.

20. A perpetual calendar as claimed in claim 17, wherein:

said calendar data comprising indications of the days of the month by number and said indexing means are each multiply listed; and said calendar data comprising indications of the days of the week by name and said third calendar data including indications of the months of the year and including said indications of January are each singly listed.

21. A perpetual calendar as claimed in claim 17, wherein:

said calendar data comprising indications of the days of the month by number are multiply listed in nineteen columns; and said indexing means, said calendar data comprising indications of the days of the week by name, and said third calendar data including indications of the months of the year and including said indications of January are each singly listed.

22. A perpetual calendar as claimed in claim 21, wherein:

said calendar data comprising indications of the days of the week by name are listed in columns;

said third calendar data are listed in columns in registry with said columns of said singly listed calendar data comprising indications of the days of the week by name; and the positions of said singly listed indexing means are in registry with the middle seven columns, between the seventh and thirteenth columns, inclusive, of said multiply listed calendar data comprising indications of the days of the month by number multiply listed in nineteen columns.

23. A perpetual calendar as claimed in claim 22, wherein:

said other of first and second means comprises a movable, flexible medium.

24. A calendar as claimed in claim 1, wherein:

said indication representing January of any year is listed in a column including an indication of the month of May of said indications of the months of the year.

25. A perpetual calendar comprising in combination:

first means bearing first calendar data;

second means movable relative to said first means and bearing second calendar data;

one of said first and second calendar data comprising indications of the days of the week by name, and the other of said first and second calendar data comprising indications of the days of the month by number;

one of the first and second calendar data being multiply listed, and the other of the first and second calendar data being singly listed;

means for controlling adjustment of said second means relative to said first means in accordance with different occurring calendar interrelationships of said first and second calendar data each month, comprising multiply listed third calendar data including indications of the months of the year associated with one of said first and second means and corresponding indexing means comprising a single, fixed index position associated with the other of said first and second means; and means for extending the usability of the calendar to an indefinitely long time, comprising means for determining and making an adjustment each year of said third calendar data relative to said indexing means and to said one of said first and second means comprising third means with said third calendar data including an indication of January of a new year, separate and distinct from the indication of January of the year, and listed relative to the indication of December according to the length of the month of December in a column including an indication of the month of May of said indications of the months of the year, and said third means comprising a flexible medium in an endless loop configuration attached to and movable relative to said one of said first and second means and bearing said third calendar data including said indication of January of a new year for display in a single listing at a time relative to said single, fixed index position.

26. A calendar as claimed in claim 25, wherein:

said flexible medium displays a single listing of seven columns of said multiply listed third calendar data at a time; and said single index position on said other of said first and second means is in operative relationship with said displayed single listing of said multiply-listed third calendar data.

27. A calendar as claimed in claim 25, wherein:

said third calendar data comprising indications of the months of the year and including an indication of January of a new year and said calendar data comprising indications of the days of the week by name are associated with said one of said first and second means; and said calendar data comprising indications of the days of the month by number and said indexing means comprising a single index position are associated with said other of said first and second means.

28. A calendar as claimed in claim 27, wherein:

said calendar data comprising indications of the days of the week by name are singly listed in seven columns; and said calendar data comprising indications of the days of the month by number are multiply listed in thirteen columns.

29. A calendar as claimed in claim 28, wherein:

said single, fixed index position on said other of said first and second means is in registry with the middle column of said columns of said multiply listed calendar data comprising indications of the days of the month by number; and said middle column of said indications of the days of the month by number includes the indication of day 1 of the month.

30. A calendar as claimed in claim 27, wherein:

said calendar data comprising indications of the days of the week by name are listed in columns;

said displayed single listing of seven columns of said multiply listed calendar data comprising indications of the months of the year, including an indication of January of a new year, are put in registry with said columns of said calendar data comprising indications of the days of the week by name; and said single index position is in registry with the middle column of said thirteen columns of said calendar data comprising indications of the days of the month by number.

31. A calendar as claimed in claim 30, wherein:

said second means comprises a movable, flexible medium.

* * * * *